US009078534B2

(12) United States Patent
Manasharov et al.

(10) Patent No.: US 9,078,534 B2
(45) Date of Patent: Jul. 14, 2015

(54) BAG HOLDER FOR SHOPPING BAGS

(71) Applicants: David Manasharov, Ashdod (IL); Dani Gal, Ashdod (IL)

(72) Inventors: David Manasharov, Ashdod (IL); Dani Gal, Ashdod (IL)

( * ) Notice: Subject to any disclaimer, the term of this patent is extended or adjusted under 35 U.S.C. 154(b) by 0 days.

(21) Appl. No.: 13/965,403

(22) Filed: Aug. 13, 2013

(65) Prior Publication Data

US 2015/0048638 A1 Feb. 19, 2015

Related U.S. Application Data

(60) Provisional application No. 61/742,434, filed on Aug. 13, 2012.

(51) Int. Cl.

| | |
|---|---|
| ***A45F 5/10*** | (2006.01) |
| ***A47F 13/08*** | (2006.01) |
| ***B66F 19/00*** | (2006.01) |

(52) U.S. Cl.

CPC ..... *A47F 13/085* (2013.01); *B66F 19/00* (2013.01); *A45F 2005/1033* (2013.01)

(58) Field of Classification Search

CPC ..... A45F 5/1026; A45F 2005/1033; A47F 13/085; B66F 19/00

USPC ..... 294/26, 137, 158, 169, 3.6

See application file for complete search history.

(56) References Cited

U.S. PATENT DOCUMENTS

| | | | | | |
|---|---|---|---|---|---|
| 1,967,560 | A | * | 7/1934 | Oberg | 294/169 |
| 3,197,097 | A | * | 7/1965 | Casuer et al. | 223/113 |
| 4,023,844 | A | * | 5/1977 | Roberts | 294/26 |
| D356,258 | S | * | 3/1995 | Hult | D9/434 |
| 5,487,581 | A | * | 1/1996 | Carmo et al. | 294/137 |
| D386,409 | S | * | 11/1997 | Santini | D9/434 |
| D458,130 | S | * | 6/2002 | Ronne et al. | D9/434 |

* cited by examiner

*Primary Examiner* — Dean Kramer

(57) ABSTRACT

A bag holder comprises of a base support and a pair of handles. The base support comprises a connection hole, a pair of upper stoppages, a pair of axes that form a pair of gaps, a pair of lower stoppages, and a vertical neck that ends in a rounded hook that creates a space and, in turn, ends in a hook tab. The gap between the hook tab and the main body of the base support constitutes an exit/entrance path. Each of the handles comprises a main body whereby one end of its bottom part includes a connection gap that is formed by a pair of tabs whose upper part constitutes a stoppage. The connection gap includes an axis and the main body of each handle has a stopping gap at its other end that is formed by a pair of tabs.

2 Claims, 5 Drawing Sheets

BAG HOLDER FOR SHOPPING BAGS

RELATED APPLICATIONS

This application is a continuation of U.S. Provisional Patent Application No. 61/742,434 filed on 13 Aug. 2012.

TECHNICAL FIELD

The present invention refers to a bag holder that is designed to enable the user to hold several bags containing products.

BACKGROUND ART

After shopping, especially after grocery shopping at a supermarket or open-air market, the shopper is left holding several full, heavy bags in his or her hands, which may be uncomfortable and even painful. The present invention provides a bag holder that solves this problem.

THE INVENTION

Figure 1:
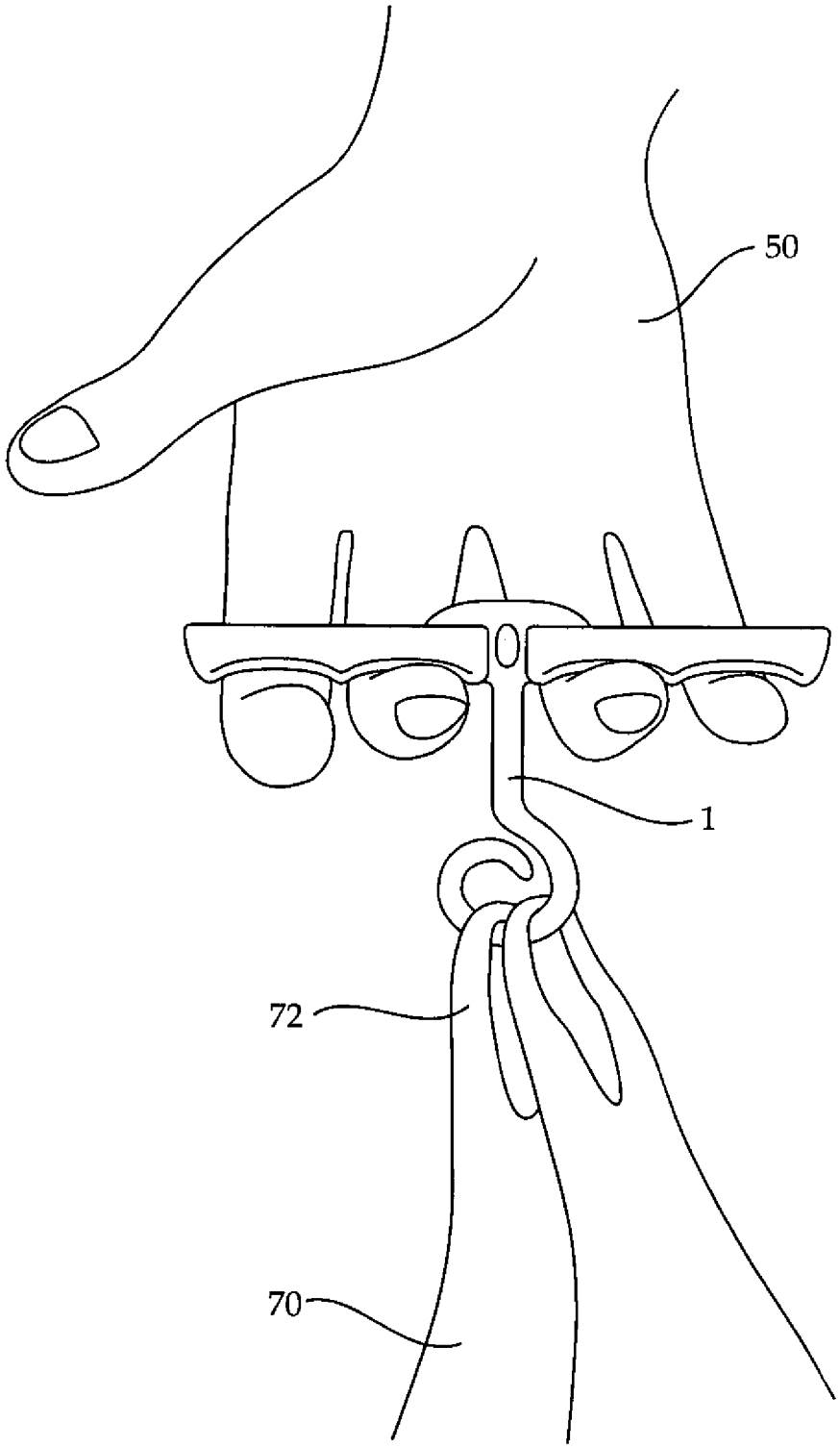
FIG. 1 describes the bag holder (1) in use.

The objective of the present invention is to provide a bag holder (1) comprising a base support (2) and a pair of handles (8*a*) and (8*b*). The base support (2) is described in detail in FIG. 4 and it comprises the following elements: a connection hole (14), a pair of upper stoppages (5*a*) and (5*b*), a pair of axles (4*a*) and (4*b*) that form two gaps (32*a*) and (32*b*), a pair of lower stoppages (5*c*) and (5*d*), a vertical neck (44) that ends with a rounded hook (7) that, in turn, ends in a hook tab (6) that creates a space (3). The gap between the hook tab (6) and the main body of the base support (2) constitutes an exit/entrance path (111). In addition, the base support (2) may include a couple of slots (17*a*) and (17*b*) on the side wall of the hook (7) so that when the bag holder is in a closed position, the slots (17*a*) and (17*b*) are situated between the tabs (9), as described for example in FIG. 9.

Figure 5:
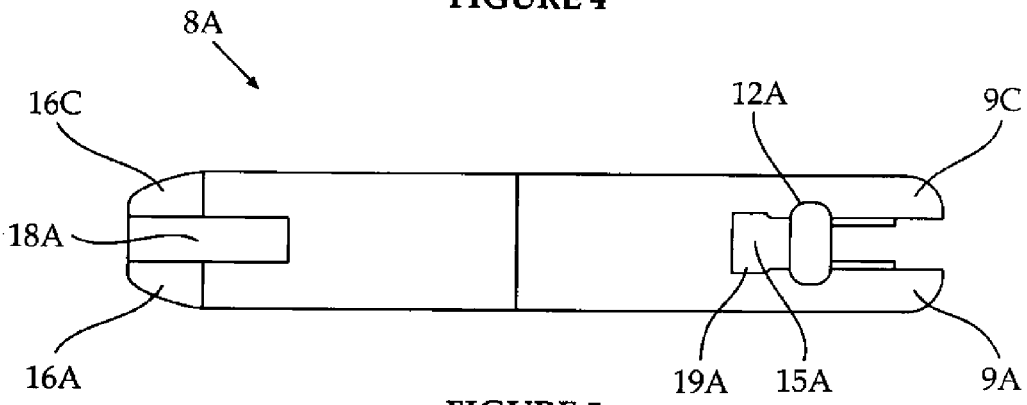
FIG. 5 is a bottom view of the handle (8*a*).
Figure 6:
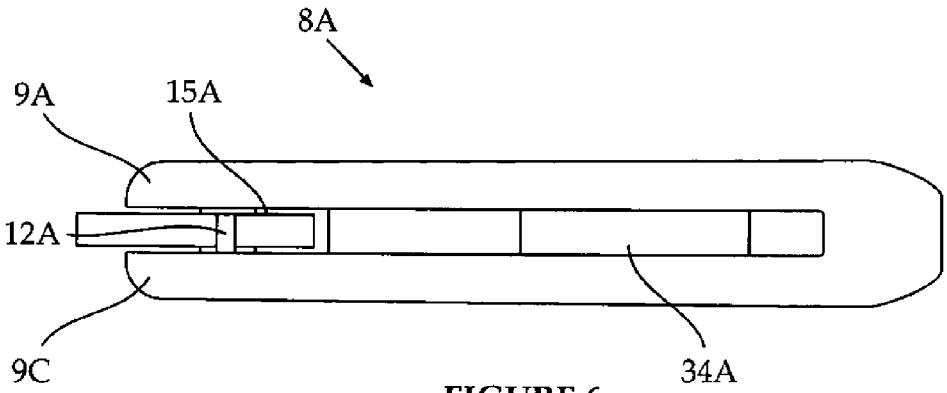
FIG. 6 is a top view of the handle (8*a*).

The handles (8*a*) and (8*b*) are similar one to each other and are described in detail in FIGS. 5-8. FIGS. 5 and 6 describe the handle 8*a* and FIGS. 7 and 8 describe the handle 8*b*. The following description of handle 8*a* applies also to handle 8*b*.

The handle 8*a* comprises a main body whose bottom part, which is described in FIG. 5, has on one side a connection gap (19*a*) that is in fact formed by tabs (9*c*) and (9*a*) whose upper parts constitute a stoppage (15*a*). The connection gap (19*a*) contains an axis (12*a*). The other side of the main body of the handle (8*a*) has a stopping gap (18*a*) that is in fact formed by tabs (16*c*) and (16*a*). The handle (8*a*) may also include a locking tab (16).

The handle (8*a*) is connected to the base support (2) whereby the axis (12*a*) is inserted into the axle (4*a*) and thus can be rotated about 90 degrees. The upper stoppage (5*a*) corresponds with the stoppage (15*a*) and thus restricts the opening of the bag holder (1). In addition, the lower stoppage (5*c*) corresponds with the main body of the base support (2) and thus restricts the closing of the bag holder (1). When the bag holder (1) is in closed position, the slots (17*a*) and (17*b*) are attached to the stopping gaps (18*a*) and (18*b*) and help to close the holder (1). In addition, the locking tabs (16) are inserted into the exit/entrance path (111) as well as into the upper part of the space (3) and also help close the hook (7).

Folding and opening shopping bag and package holder handle device, with Folding and opening hook and handle method.

FIG. 1 shows a perspective view of a hand 50 comprising an open manner bag holder 1 containing a bag 70 by bag handles 72. A hand 50 may be a right or left hand.

A hand 50 may be described as one or two hands that each hand is hand 50, as one hand 50 may be for holding a bag holder 1 and the second hand may be for opening and closing the bag holder 1.

A bag 70 may be a plastic shopping bag, fabric bag, a wire, a wire tide box, a rope, or any kind of load that has a thin handle and a wider grip (handle) is needed. The bag 70 may be in any weight, that a person can holds in his hands.

The bag holder 1 can be used to hold few plastic bags 70 by holding their handles 72, preferably from approximately 2-10 plastic shopping bags 70 by bag handles 72 more preferably from 4-8 plastic shopping bag handles 72.

The bag holder 1 will be described more with reference to the FIGS. enclosed to this patent application and may be used in any application to carry any kind of load, such as a plastic shopping bags, wire packed boxes, a rope tide load, etc, etc.

The bag holder 1 will be described more in two manners in which one manner is a folded manner bag holder as described more with reference in FIGS. 3, 9, 10 and FIG. 12, and another manner as an open manner bag holder (as shown in FIG. 1) and an open manner bag holder (shown in FIG. 2), described more with reference in FIGS. 1-2-11 and 12.

Figure 2:
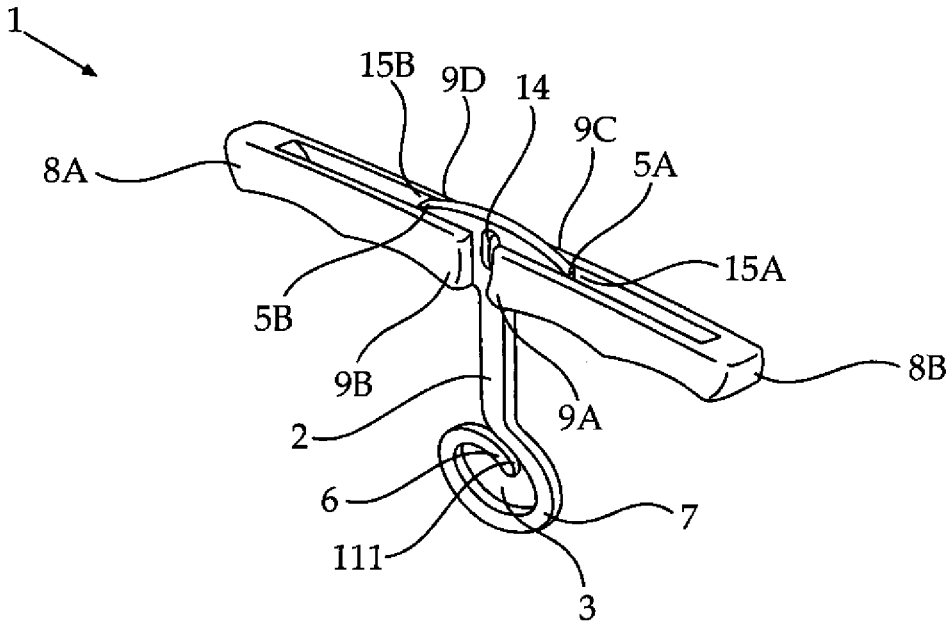
FIG. 2 describes the bag holder (1) in an opened position.
Figure 3:
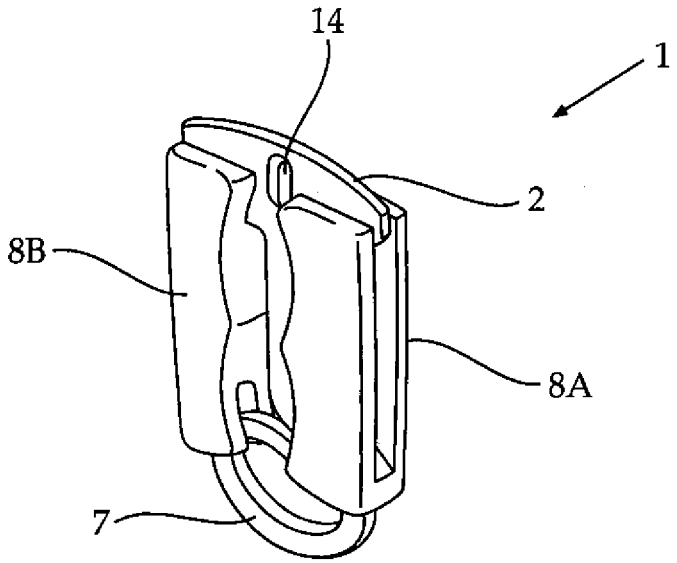
FIG. 3 describes the bag holder (1) in a closed position.
Figure 13:
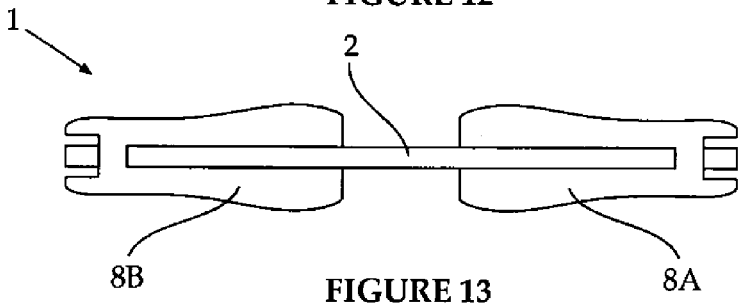
FIG. 13 is a top view of the bag holder (1) in an opened position.

As handles 8A and 8B as described in FIGS. 1-2 are lifted upwards by hand 50 from the hook 7 and all the way upwards—handles 8A and 8B bars, axis's 12A and 12B are pivoting upwards and sideways from the hook 7 base support 2 on axles 4A and 4B until handles 8A and handle 8B are forming a T shape open manner of the bag holder (as shown in FIGS. 1-2) and as handles 8A and handle 8B are pulled downwards and pivoting on a base support 2 axle 4A and axle 4B as bars, axis's 12A and 12B and all the way downwards until handles 8A-8B reach hook 7 and form a closed manner of the bag holder, a closed manner bag holder is shown and described more with reference to FIG. 3 and FIG. 13.

An open manner the bag holder 1 may be used for holding and carrying plastic shopping bags 70, as shown in FIG. 1, T shirt bags, fabric bag, a wire packed boxes, etc, etc. or any kind of load. A closed manner of the bag holder may be used as a key holder once handles 8A and 8B are folded down or opened and a key ring, snap hook, chain hanger etc, etc may be inserted into the hook 7 or into the connection hole 14.

A connection hole 14 is configured to allow a key ring, a snap hook, a strap, rope, wire, a chain, etc, etc, to connect to the connection hole 14.

A connection hole 14 may be connected to a shoulder strap as the strap may contain a snap hook, a swivel hook, a hanger etc, etc. and by connecting a strap to the connection hole 14 then the user may hang the load that may be connected to the bag handles 72 on the hook 7 and hang the bags with the bag handles on a shoulder and have a hand free bag holder with the support of a strap that may be connected to a connection hole 14.

FIG. 2 shows a perspective view of an open manner of the bag holder 1, and a closed manner of the bag holder will be described more with reference to FIGS. 3-7-10-13, according to one embodiment of the present invention, and is not intended to limit the scope of the present invention. The bag holder 1 comprises, a base support 2, a hook, 7, a hook tab 6, handle 8*a*, a handle stoppage 15*a*, handle 8*b*, a handle stoppage 15*b*, a base stoppage 5*a*, a base stoppage 5*b*, tab 9; tab 9*b*, tab 9*c*, tab 9*d*, a connection hole 14, a space 3, and an entrance, exit path 111.

The bag holder 1 may comprise any material such as: aluminum, metal, copper, steel, plastic, rubber, etc, etc. preferably plastic handles (8*a*, 8*b*) and base support 2 aluminum.

The bag holder 1 may comprise one or plurality of hook 7, one or a plurality of hook tab 6, at least two handles 8*a* and 8*b*, and at least one handle for each side of the base support 2, described in FIGS. 2, 3, 10, 11 and FIGS. 12-13, the bag holder 1 may comprise one or a plurality of connection holes 14, one or a plurality of entrance, exit path 111, bag holder 1 may comprise a plurality of base stoppage 5*a* and 5*b* and may comprise a plurality of tabs 9; 9*b*, 9*c* and 9*d*.

The bag holder 1 may comprise at least one handle 8*a* or 8*b*, either on one side of the base support 2 or on both sides of the base support 2 as shown in FIGS. 1-2-3-9-10-11-12-13, connected to the base support 2. meaning that the bag holder may have only one handle 8*a* or 8*b* connected to the base support 2 and may be opened at approximately 90 degrees from a base support 2 and folded down at approximately 0-5 degrees, as one side of the bag holder as shown in FIG. 3.

The bag holder 1 may comprise a pin that may connect another bag handle to each other and may have a male and female, or giver and receiver, connection that will make two bag handles as a one unit.

The base support 2 may comprise a snap hook mechanism with a spring and or a click mechanism that may open and close the entrance, exit path 111 for items that may be loaded in the hook 7 may stay lucked until released from the bag holder. A snap hook May be with a button that when pressed a gate may be opened and closed.

The bag holder 1 may take any shape or form such as: a round shape, a rectangular shape, a square shape, etc, etc. and or, a combination of shapes that each part may have that may form a unique shape, such as for example a rounded handles 8*a*, 8*b* and a flat base support 2 that may have a rectangular hook 7 and a rounded clip.

The bag holder 1 may be in any size once is opened and in the open manner as shown in FIG. 2 preferably the base support 2 with an open handles 8*a* and 8*b* all the way upwards and form approximately 180 degrees and approximately 90 degrees each handle (8*a* and 8*b*) as shown in FIG. 2 may be approximately 8 cm-15 cm wide (horizontal view) once opened (as shown in FIG. 1 and FIG. 2), preferably from 10 cm-12 cm wide once opened (as shown in FIG. 1 and FIG. 2), as a base support 2 may be in any size and height (vertical view) from approximately 3 cm-10 cm long, preferably from 4 cm-8 cm long, more preferably from 5 cm-7 cm long. Meaning, a vertical view from the bottom of the hook 7 to the top of the connection hole 14.

The bag holder 1 may have a button or a track mechanism that once pressed or moved bay a hand 50 (shown in FIG. 1) may open and close the handles 8*a* and 8*b* together and or separately, and may comprise a cogwheel mechanism for the handles 8*a*, 8*b* to rotate upwards to form the open manner bag holder, and downwards to form the closed manner the bag holder.

Handles 8*a* and 8*b* may be connected to each other by a spring that may allow handles 8*a* and 8*b* to open and close with a resistance of a spring.

The bag holder 1 may comprise a bottle opener, a laser flashlight, a flashlight, a magnet, a knife, a snap hook, a strap, etc, etc that may attached to the base support 2, and or, to the handles 8*a* and 8*b*, and or may be designed in or on the base support 2 and or the handles 8*a* and 8*b*.

An open manner of the bag holder 1 may have a clicking mechanism, preferably with a clicking mechanism for both handles 8*a* and 8*b*, that once handles 8*a* and 8*b* handles stoppages 15*a*, 15*b* reach the base support 2 stoppages 5*a*, 5*b* then a click may hold handles 8*a*, 8*b* in an open position, as shown in FIG. 2, without letting handles 8*a*, 8*b* to fall down to the base support 2 hook 7 automatically with the force of gravity.

An open manner of the bag holder may be configured to have an entrance, exit path 111 on either side of the bag holder and as the handles 8*a* and or 8*b* may be open as the entrance, exit path 111 is open for loading items on the base support 2 hook 7.

The connection hole 14 is configured to allow a key ring, a snap hook, a strap, rope, wire etc, etc, to connect to the connection hole 14 and by connecting a strap to the connection hole 14 as a user may hang the load that may be connected to the bag handle 72 as shown in FIG. 1 and hang the bags with the bag handle 7 (as shown in FIG. 1 on a shoulder instead of carrying by hand 50 and have a hand free bag holder.

The bag holder 1 may be divided into two parts that when are connected together may form the bag holder. meaning that the base support 2 may be divided in the center or at any other place and may comprise a rail and a track that one part may be a male and the other may be a female, and as the two are connected or slide to each other to form the folding bag holder.

The bag holder 1 may comprise springs that may be connecting handles 8*a* and 8*b* to the base support 2 axles 4*a* and 4*b*, and the springs may create a resistance in which handles 8*a* and 8*b* may be pulled downwards with the pressure of a spring and back into a the closed manner.

The bag holder 1 may comprise a cart or trolley coin size tab that may be on the hook 7 and or may be on top of the base support 2 as the connection hole 14 may comprise an extended part that may fit a cart or trolley lucking system and as an extended part on top of the base support 2 may open a lucking cart or trolley mechanism system.

The bag holder 1 Handles 8*a* and 8*b* may comprise a knife, a nail buffer, a cart or trolley releaser coin shaped tab (or part), a bottle opener, etc, etc.

The bag holder 1 may comprise at least one handle 8*a* and at least one handle 8*b* that may be connected to the base support 2 and to form the bag holder.

FIG. 3 shows a perspective view of a folded manner of the bag holder 1 according to one embodiment of the present invention, and is not intended to limit the scope of the present invention. A folded manner bag holder 1 comprises all the elements described in FIG. 2 with handles 8*a* and 8*b* folded down and touching a hook 7. A folded manner of the bag holder 1 comprises a handle 8A, a handle 8B, a base support 2, a hook 7, ring and a connection hole 14. A folded manner of the bag holder 1 may take any shape once closed and form the folded manner bag holder, may be a round shape, a rectangular shape, a square shape, etc, etc. A closed manner of the bag holder 1 may comprise any material, such as: copper, steel, metal, plastic, aluminum, etc, etc, preferably from plastic and aluminum, more preferably from aluminum.

The folded bag holder 1 may comprise a key ring, a chain, a bracelet etc, etc that may be connected to the bag holder 1 via the hook 7 and or, via the connection hole 14 that may transform the bag holder 1 into a multiuse device that once the bag handles 8*a* and 8*b* are opened as shown in FIG. 1-2 and as an open manner bag holder 1 as shown in FIG. 1 and FIG. 2 the bag holder 1 may be used for carrying shopping bags or any kind of load, and when the bag handles 8*a* and 8*b* are in the folded manner it may be used as a key holder and or may be hanged on a purse, a bag etc, etc.

The bag holder 1 connection hole 14 may comprise a strap, wire, etc, etc that may be connected to the connection hole 14 and as items may be loaded on the closed manner bag holder 1 or the open manner bag holder 1 as shown in FIG. 2, the bag holder 1 may be hanged on a shoulder and items may be carried by hand and or by a shoulder.

A strap, wire or any other hanging method may be connected to the bag holder 1 via the connection hole 14 and or may be a round closed as a circle on both ends strap, wire that may be connected to the base support 2 and or the handles 8*a* and 8*b* and without the connection hole 14.

A folded manner of the bag holder 1 may be in any size, may be from approximately 2 cm-10 cm in height, preferably from approximately 4 cm-8 cm in height, more preferably from 5 cm-7 cm in height. A folded manner bag holder 1 may be in any length, preferably from approximately 1 cm-8 cm in length, more preferably from 2 cm-4 cm in length. A folded manner bag holder may be in any thickness from approximately 0.5 cm-5 cm in thickness, preferably from approximately 0.7 cm-1.5 cm in thickness.

A folded manner bag holder 1 may comprise a bottle opener, a laser flashlight, a magnet, a knife, a nail buffer, a key ring, a key holder, etc, etc that may be designed as part of the bag holder 1 and or, may be attached to the bag holder 1 on the handles 8*a*, 8*b* and or the base support 2. A bag holder 1 may be used as an advertisement tool by adding a logo of a company, a sports team, or any kind of logo or dedication writing on the handles 8*a*, 8*b* and or on the base support 2.

A bag holder 1 as shown in FIGS. 1-2-3 hook 7 may be designed as a coin that may open a cart or trolley lucking mechanism. As handles 8*a*, 8*b* are in an open manner and or as a closed manner of the bag holder 1, that as a hook 7 may be inserted into a shopping cart lucking mechanism hole, a hook 7 may release a cart/trolley chain from other carts/trolleys and make the bag holder 1 as shown in FIGS. 1-2-3 into a cart releasing device as well as a bag holder.

A folding and opening bag holder 1 will be described more with reference to FIG. 4-13 and may be described as two halves that one halve represents one handle 8*a* and the components for the handle 8*a* connected to a base support 2 axle 4*a* via bar, axis 12*a* on one side of the base support 2, and another halve that represents the handle 8*b* and the components for the handle 8*b* connected to the base support 2 axle 4*b* via bar, axis 12*b* on the other side of the base support 2 as both halves supported by the base support 2, and both halves may move up and down, sideways from the hook 7, separately with each halve (8*a* and or 8*b*) having its own mechanism, or may be connected together to the base support 2 with a cogwheel connecting both handles 8*a* and 8*b* that may make both handles 8*a* and 8*b* move as a one unit that as one handle 8*a* or 8*b* is moving upwards or downwards then the other handle 8*a* or 8*b* may move automatically with the other handle 8*a* or 8*b*.

A closed manner bag holder may be configured to have an entrance, exit gate 1 on either side of the bag holder and as the handles 8*a* and or 8*b* may be closing the entrance, exit gate 1 when handles 8*a* and or 8*b* are folded (as shown in FIG. 3) for loaded items on the base support 2 hook 7 to stay inside the bag holder 1 and inside the hook 7. A closed manner of the bag holder 1 may be with or without ring.

The bag holder 1 may be attached to a key ring, a key chain, a chain, a bracelet, a wire, a snap hook, etc, etc. and may be connected to the bag holder 1 on the hook 7 and or, to the connection hole 14 that may make the closed manner bag holder 1 into a key holder.

A closed manner of the bag holder 1 may be opened to become an open manner bag holder 1 with one hand or with two hands.

As handles 8*a* and 8*b* bars, axis's 12*a* and 12*b* revolve on the base support 2 axles 4*a* and 4*b* from the hook 7, from the closed manner bag holder 1, and all the way upwards to the stoppages 5*a*, 5*b* of the base support 2 and as handle 8*a* and 8*b* stoppages 15*a* and 15*b* reach the base support 2 stoppages 5*a*, 5*b* then a closed manner bag holder 1 becomes an open manner bag holder 1 (as shown and described in FIG. 2). And as handles 8*a* and 8*b* bars, axis's 12*a*, 12*b* revolve the axles 4*a* and 4*b* of the base support 2 from the stoppages 5*a*, 5*b* (of the base support 2) and from the stoppages 15*a* and 15*b* (of the handles 8*a*, 8*b*) and all the way downwards to the hook, hanger 7 until handles 8*a*, 8*b* tabs 9*a* and 9*c* (of handle 8*a*) and tabs 9*b*, 9*d* (of handle 8*b*) slide into the hook, hanger 7, and as hook, hanger 7 goes into the handles 8*a*, 8*b* gap 18*a* and 18*b* and a closed manner bag holder 1 is formed.

The bag holder 1 may comprise springs, rings that may be connecting handles 8*a* and 8*b* to the base support 2 axles 4*a* and 4*b*, and as the springs, rings may create a resistance in which handles 8*a* and 8*b* may be pulled downwards with the pressure of a spring, ring and as a spring, ring may hold handles 8*a* and 8*b* closed and may create a resistance in which handles 8*a* and 8*b* may be pushed inwards and to the base support 2 hook, hanger 7.

A bag holder 1 may comprise a button releasing mechanism (may be with a spring connecting handles 8*a* and 8*b* and the base support 2) on the base support 2 and as the button is pressed by a hand 50 (a hand 50 is shown in FIG. 1) then the handles 8*a* and 8*b* may open to form the open manner bag holder 1 as shown in FIG. 2 automatically as the handles 8*a* and 8*b* may also comprise springs or any other connection method that may be connected to the releasing mechanism button.

A closed manner bag holder 1 may comprise a cart or trolley releasing tab that may be on the handles 8*a* and 8*b*. and or, one handle 8*a* or 8*b* and or may be on the base support 2 that as the bag holder 1 handles 8*a* and 8*b* may be opened as to open and form the bag holder 1 as shown in FIG. 2 a coin sized tad may be on the top of the base support 2 (looking at the bag holder 1 as shown in FIG. 2 horizontally).

A closed manner bag holder 1 may comprise a cart or trolley releasing coin sized tab or part that may be on top of the base support 2 as the base support 2 connection hole 14 may comprise an extended part that may be a coin sized tab that may open a cart or trolley lucking mechanism system and may be without opening handles 8*a* and 8*b* (as described in FIG. 2) to achieve the opening of a cart or trolley lucking mechanism system. And may also be as when handles 8*a* and 8*b* may open from a closed manner bag holder 1 as shown in FIG. 3 and into an open manner bag holder 1 as shown in FIG. 2 then handles 8*a* and 8*b* may be configured to cover a cart releasing tab that may be on top of the base support 2 as handles 8*a* and 8*b* may be in movement (by hand 50) and as handles 8*a* and 8*b* may be all the way upwards to achieve an open manner bag holder 1 (bag holder 1 is shown in FIG. 2) as handles 8*a* and 8*b* may be covering an cart or trolley releaser tab, and may be that when handles 8*a* and 8*b* may be folding to become a closed manner bag holder 1 as shown in FIG. 3 and as handles 8*a* and 8*b* may be in movement downwards as a cart or trolley releasing tab may uncover and may be a built in cart or trolley opening tab.

Figure 4:
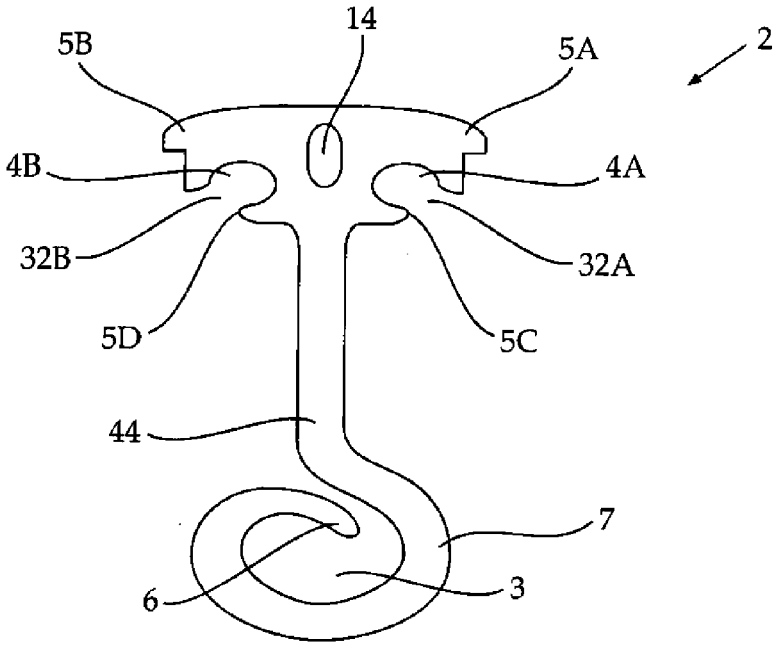
FIG. 4 describes the base support (2).
Figure 9:
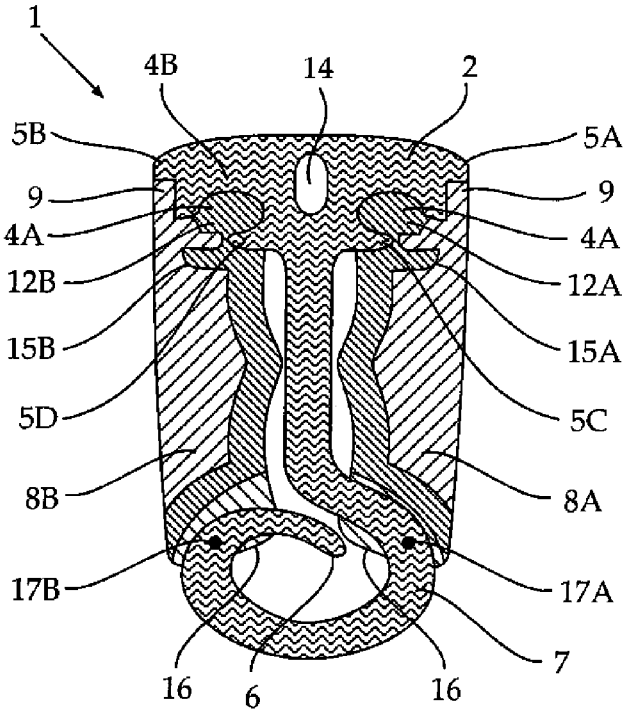
FIG. 9 is a cross section view of the bag holder (1).

FIG. 4 shows a front view of a base support 2 according to one embodiment of the present invention, and is not intended to limit the scope of the present invention. Base support 2 comprises: a base support 2 (configured to hold and connect handles 8*a* and 8*b* as shown in FIG. 9), a connection hole 14 (configured to allow a connection of another device as shown and described in FIG. 3), a hook, hanger 7 (configured to hold and carry weight as shown in FIG. 1), a gap, space 3 (configured to allow items fit inside the hook, hanger 7 as shown in FIG. 1), a hook tab 6 (configured to hold and keep items from getting out of the hook, hanger 7 as shown in FIG. 1), a neck 44 (configured to allow fingers of a hand 15 to hold the bag holder between fingers as shown in FIG. 1), a stoppage 5*a*(configured to hold handle 8*a* from getting out of the base support 2 and hold handle 8*a* from moving further then approximately 90 degrees from hook 7 once in open manner 1 as shown in FIGS. 1-2), a stoppage 5*b*(configured to hold handle 8*b* from getting out of the base support 2 and hold handle 8*b* from moving further then approximately 90 degrees from hook 7 once in open manner 1 as shown in FIGS. 1-2), a stoppage 5*c*(configured to hold handle 8*a* bar, axis 12*a* from getting out of the base support 2 and to pivot freely upwards and downwards as well as to hold the pressure that a hand 50 and a load bag 70 as shown in FIG. 1 may put on handle 8*a* bar, axis 12*a*), a stoppage 5*d*(configured to hold handle 8*b* bar, axis 12*b* from getting out of the base support 2 and to pivot freely upwards and downwards as well as to hold the pressure that a hand 50 and a load 70 as shown in FIG. 1 may put on handle 8*b* bar, axis 12*b*), An axle 4*a* (configured to allow handle 8*a* bar, axis 12*a* to pivot upwards and downwards), an axle 4*b* (configured to allow handle 8*b* bar, axis 12*b* to pivot upwards and downwards) gap 32A (configured to allow bar, axis 12*a* to be fitted in the gap 32A). Gap 32B (configured to allow bar, axis 12B to be fitted in the gap 32B).

A base support 2 may be made of any material, such as: copper, steel, metal, aluminum, plastic, etc, etc. preferably from steel, more preferably from aluminum.

A base support 2 may take any shape or form and may be a one base support 2 as shown in FIG. 4 and or may be two base supports 2 and may comprise double amount of the stoppages 5*a*,5*c*, 5*b*, and 5*d* as well as double axles 4*a* and 4*b* that may be connected to each other via a bridge as handles 8*a*, 8*b* may comprise bars, axis's 12*a*, 12*b* that may be connected to the base support 2.

A base support 2 may be in any size, preferably from approximately 1 cm-5 cm wide, More preferably from approximately 2 cm-4 cm wide (looking at the base support 2 as shown in FIG. 4 horizontally).

Base support 2 may be in any height from 2 cm-15 cm in height, preferably from approximately 3 cm-8 cm in height, more preferably from 4 cm-7 cm in height.

Base support 2 may be in any thickness from approximately 0.1 cm-5 cm in thickness, preferably from approximately 0.2 cm-1 cm in thickness, more preferably from 0.3 cm-0.5 cm in thickness.

A base support 2 may be configured as a shell and may be covered with a soft material for a soft hold, or may be from a hard material, preferably from thermoplastic, more preferably from rubber.

A base support 2 may be a one part (as shown in FIG. 4) and or, may be few parts coming together to form the base support 2, such as: a base support 2 top part (with the stoppages 5*a*,5*b*,5*c*,5*d* and the axle 4*a* and 4*b*) may be a one part and a hook, hanger 7 may be another part, and the neck 44 may be another part that may be assembled together with a slide into each other path or rails, and or with a screw in path as male and female parts assembled together.

A base support 2 may be divided into two or more parts that when connected together may give a base support 2, such as a hook 7 may be one part and the neck 44 may be another part that may have a screwed in path and may be connected to each other, and may be connected in ant part of the base support 2.

Base support 2 may comprise a plurality of stoppage 5*a*, 5*b*, 5*c*, and 5*d* and may comprise a plurality of axles 4*a* and axis 4*b*, and may comprise a plurality of a connection hole 14.

Stoppages 5*a* and 5*b* may prevent from handles 8*a* and 8*b* from moving further then 180 degrees and may also be configured to hold handles 8*a* and 8*b* at an open position (as shown in FIG. 2 and as an open manner bag holder 1) as handles 8*a* and 8*b*(handles 8*a*, 8*b* are shown and described in FIGS. 5, 6, 7 and 8 and may comprise tabs that may click to form an open manner bag holder 1 as shown in FIG. 2) may comprise a clicking tabs as when handles 8*a* and 8*b* stoppages 15*a* and 15*b* reach the stoppages 5*a* and 5*b* that the base support 2 comprises, a click on both sides may hold handles 8*a* and 8*b* in an open position bag holder 1 as shown in FIG. 2 until a hand may pull handles 8*a* and 8*b* down to the base support 2 hook, hanger 7 to form a closed manner bag holder 1 as shown in FIG. 3, and as handles 8*a* and 8*b* stoppages 15*a* and 15*b* pulled or pushed downwards, a click of detachment from a base support 2 stoppages 5*a* and 5*b* may release handles 8*a*, 8*b* stoppages 15*a*, 15*b* from a base support 2 stoppages 5*a*, 5*b*.

A base support 2 may comprise a plurality of connection holes 14. A connection hole 14 may be in any size or form such as: a round connection hole, a square hole, a rectangular hole etc, etc. A connection hole 14 may allow a connection of a clip snap hook, a key ring, a snap hook, a carabineer, a spring snap hook, a strap with a hook, etc, etc.

An axle 4*a* and axle 4*b* may be in any diameter that may fit to hold bar, axis 12*a* and bar, axis 12*b* as described in FIG. 9.

A base support 2 may have a plurality of axle 4*a* and axle 4*b*. A base support 2 neck 44 may be in any size, form, thickness and width. Preferably neck 44 may be in a approximately 2 cm-4 cm in height, more preferably 3 cm in height. A base support 2 neck 44 may be in any width from approximately 0.1 cm-3.5 cm, preferably from approximately 0.2 cm-1 cm wide, more preferably from 0.3 cm-0.7 cm wide. Base support 2 neck 44 may be in any thickness from approximately 0.1-3.0 cm, preferably from approximately 0.1 cm-0.5 cm thick, more preferably from approximately 0.2 cm-0.4 cm thickness. A base support 2 neck 44 may comprise a snap hook that may open and close a gap that entrance, exit gate 111 may have.

A base support 2 neck 44 may comprise a spring operated gate, bar, clip etc, etc, and as a gate, bar, clip etc, etc is pulled upwards (by hand with the resistance of the spring to pull a bar, tab, clip, gate downwards) a gate may open and may allow items (bag handles 72 as shown in FIG. 1) to be loaded into a hook, hanger 7, and when the gate, bar or clip, etc, etc is released from the pressure (or movement) caused by a hand 15 then a spring may push a gate, bar, tab downwards automatically and close entrance, exit gate 1 gap that may be having (entrance, exit gate is shown in FIG. 4) as a gate bar, clip may stop onto a hook, hanger 7 hook tab 6.

Base support 2 may be one or more parts coming together to form the base support 2. Meaning that the base support 2 neck 44 may be one part and hook, hanger 7 may be another part and the top of the base support 2 axles 4*a* and 4*b* and the connection hole 14 may be another part and the neck 44 may be connected to and or, may be connecting hook, hanger 7 and the base support 2 top as the neck 44 may comprise a screwed in or screwed to path that may be connecting two or three parts together to form the base support 2. Such as one hook, hanger 7 connected to the neck 44 on top of hook, hanger 7 (as shown in FIG. 4 as a one unit) and another connection that the neck 44 may comprise and that may be connected to the top part of the base support 2 and between the base support 2 axles 4*a* and 4*b*. and as the three parts as a hook, hanger 7 to the neck 44 and the neck 44 connected to the top of the base support 2 and between the base support 2 axles 4*a* and 4*b* and as all three parts may be connected together may form the base support 2 as shown in FIG. 4.

Figure 7:
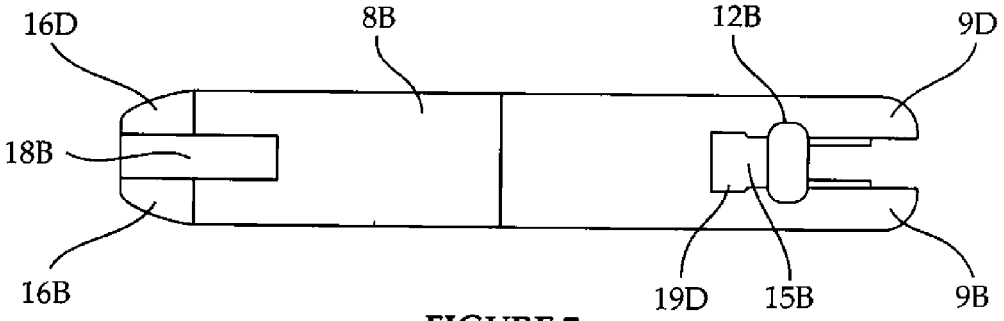
FIG. 7 is a bottom view of the handle (8*b*).

Base support 2 may comprise a plurality of parts to form the base support 2. Base support 2 neck 44 may comprise a swivel snap hook. Gap 32A and gap 32B may be in any length that may allow bar, axis 12A of handle 8A and bar, axis 12B of handle 8B (as shown in FIG. 7) to connect to a base support 2 axle 4A and axle 4B.

Hook, hanger 7 may be in any shape or form such as: a round hook hanger (as shown in FIG. 4) may be a square shape, may be a snap hook, may be an open hook, may be with a clip that may open and close a gap for allowing items to go in and out of the hook.

A hook, hanger 7 may be a hook that may comprise a clip and may be configured as a one unit, as a hook, hanger 7 may hold a bag handles 72 (shown in FIG. 1), and a clip may allow an entrance and an exit of bag handles 72 in and out of a hook, hanger 7 and of the gap, space 3, and as a clip may be flexible for allowing bag handles 72 to slide in and out of the hook, hanger 7, and in and out of a gap, space 3. a clip may be touching (or may have a gap or space) a neck 44. And a clip may hold bag handles 72 inside a hook, hanger 7 and into a gap, space 3 automatically once bag handles 72 are into a hook, hanger 7, and a clip may be configured to be flexible and to move to allow items to go inside hook, hanger 7 and into gap, space 3, and as bag handles 72 pass a clip and may be into hook, hanger 7 and into gap, space 3, then a clip may move back to its original place automatically, and when bag handles 72 are moved out of hook, hanger 7 gap, space 3, then a clip may move to allow the bag handles to get out of hook, hanger 7, and a clip may go back to it place and may stick or may be touching neck 44 (assuming that a clip may be designed to touch the neck 44). And a clip may allow an entrance and exit of a key ring (or any other part) in and out of hook, hanger 7.

Hook hanger 7 may have a tab and a spring that may be moved upwards and downwards manually, and may open a gate for allowing items to get in the hook 7 gap, space 3, and may close a gate as a tab is released and may move to close a tab by a Pressure that a spring may cause.

A base support 2 may have a spring, rubber, plastic mechanism for opening and closing a gate for allowing items to go in and out of the base support 2 hook, hanger 7 gap, space 3.

A base support 2 may comprise a snap hook mechanism, a hook with latch, a carabineer hook, a swivel snap hook, a spring snap hook, etc, etc. a hook gate may be opened and closed manually or automatically.

A base support 2 may comprise a plurality of hook, hanger 7.

A hook, hanger 7 may be configured to be in any direction, may be sideways, backwards or may be in a front side of a bag holder, and or may be on the back side of bag holder, or may be on both the front side and the back side of the bag holder 1 (as shown in FIGS. 1-2-3).

A hook, hanger 7 is configured to hold and carry items, as a hook tab 6 is configured to hold loaded items inside the hook, hanger 7, and as the gap 3 is configured to provide space for items inside the hook, hanger 7, and an entrance, exit path is configured to provide a passage for items to go in and out of the clip hanger 7.

A Gap, space 3 may be in any size from approximately 0.1 cm-4.5 cm in diameter, preferably from approximately 0.5 cm-3.5 cm in diameter, more preferably from 1 cm-2.5 cm in diameter, and is configured to hold and keep loaded items (approximately 3-15 pairs of shopping bag handles 72) inside the hook, hanger 7.

A hook tab 6 may be in any length that may hold the loaded items from getting out of the hook, hanger 7. preferably from approximately 0.1 cm-2 cm from the neck line. More preferably from 0.3 cm-0.8 cm from the neck line.

A hook tab 6 may be in any width from approximately 0.1 cm-1 cm. preferably the same width as the hook, hanger 7.

A hook tab 6 may comprise a spring connection and a tab that may be used as a gate for allowing closing and opening of an entrance, exit 1 gap.

A hook tab 6 may be in any shape or form and may comprise a clip that may be attached to the neck 44 and having a space of approximately 0.1 cm-0.1 cm space for preventing from loaded items (bag handles 72 as shown in FIG. 1) from getting out of a hook, hanger 7 and may move with respect to neck 44 when items may be loaded into the hook, hanger 7 and as an opening and closing gate for items to be loaded into the hook, hanger 7 and as the gate may be closed automatically.

A base support 2 hook, hanger 7 may comprise slots that may allow pins that handles 8*a*, 8*b* tabs 9*a*,9*c* and tabs 9*b*, 9*d* may comprise for allowing a luck of the handles 8*a*, 8*b* to base support 2 via hook, hanger 7 (as described in FIG. 7) and as handles 8*a* and 8*b* (shown in FIG. 7) may comprise pins that may slide into the hook, hanger 7 that may comprise slots in which when connected together they create a luck and may prevent from handles 8*a* and 8*b* from detaching from a hook, hanger 7. and or, may be the other way around as the base support 2 hook, hanger 7 may comprise pins and the handles 8*a* and 8*b* may comprise slots in which may allow a hook, hanger 7 pins to slide into the handles 8*a* and 8*b* slots and create a luck.

Base support 2 may comprise connection holes as axles for handles 8*a* and 8*b* to be connected to the base support 2 via pins, screws etc, etc that may be as axis's (instead of axis's 12*a* and 12*b* that the handles 8*a*, 8*b* comprise as shown in FIGS. 5*a*,5*b* and 6*a* and 6*b*).

Base support 2 is configured to allow handles 8*a*(shown in FIG. 6, 7) and handle 8*b*(shown in FIG. 6, 7) to be connected to the base support 2 via bar, axis 12*a* and via bar, axis 12*b* that handles 8*a* and handle 8*b* are comprising and connect them to the base support 2 via axle 4*a* and axle 4*b*, and by connecting the three parts together, handle 8*a* bar, axis 12*a* to the base support 2 axle 4*a* via gap 32*a*, and by connecting a handle 8*b* bar, axis 12*b* to the base support 2 axle 4*b* via gap 32*b*(as shown in FIG. 7), the bag holder 1 (as shown in FIGS. 1-2-3) is formed.

Base support 2 is configured to have rounded edges for keeping from plastic shopping bags to tare once a pressure of a weight that a loaded items may create, and as the loaded items pull the hook, hanger 7 downwards and to the ground once the open manner bag holder 1 (as shown in FIG. 1) is loaded and lifted from the ground, A hook, hanger 7 may be made of any material that may hold a substantial amount of pressure, such as metal, steel, plastic, aluminum, etc, etc. and may comprise a plurality of materials to form a strong hook, hanger 7.

A hook tab 6 may be in any shape or form such as a wavy shape, an arched shape, etc, etc, and may be made of a flexible material such as plastic, rubber, metal etc, etc.

A hook tab 6 may be a one part (as shown in FIG. 4) and or may be a separate part that may be connected to the base support 2 via screw, pin, spring etc, etc.

A hook tab 6 may have a male female (giver and receiver) connection pattern to the base support 2.

Base support 2 may have holes on the top of the base support 2 (instead of the axle 12*a* and axle 12*b*) and the axle 12*a* and axle 12*b* gaps 32*a* and 32*b* may be closed, and may form a closed hole that may allow a pin or a screw to be inserted inside the holes, and the holes may be used as axle, and a pin or a screw may be used as an axis that may connect the handles 8*a* and handle 8*b* to the base support 2 as the handle 8*a* and handle 8*b* may have holes instead of a bar, axis 12*a*, 12*b* and that may allow the handles to rotate upwards and downwards with respect to the base support 2 as the base support 2 stoppages 5*a*, 5*b* are preventing from the handles 8*a*, 8*b* from moving upwards more then approximately 180 degrees and as a T shaped bag holder (as shown in FIGS. 1-2).

Base support 2 axle 4*a* may comprise a spring that may be configured to create a resistance once the handle 8*a* is connected to the base support 2 axle 4*a* (for the open manner bag holder 1 and the closed manner bag holder 1)

Base support 2 axle 4*b* may comprise a spring that may be comprised to create a resistance once the handle 8*b* is connected to the base support 2 axle 4*b* (for the open manner bag holder 1 and the closed manner bag holder 1). And as both axles 4*a* and 4*b* may comprise a spring that may be connected to handles 8*a* and 8*b* on one end, and to the base support 2 axles 4*a*, 4*b* on the other end, and as both handles 8*a* and 8*b* and the base support 2 axles 4*a* and 4*b* are connected via a spring as a spring may create a pulled back mechanism that may bring handles 8*a* and 8*b* to a folded manner bag holder 1 (folded manner 1 shown in FIG. 3) automatically.

Base support 2 axles 12 and 12*b* and stoppages 5*a*, 5*b* and 5*c*, 5*d* may be a round or flat portion that provides a sufficient structural integrity as to be able to withstand a great amount of pressure from external force without detaching from the base support 2 axle 12*a* once handle 8*a* and 8*b* are connected to the base support 2 and is open at approximately 90 degrees (each handle 8*a* and 8*b*) from the base support 2 hook, hanger 7 (as shown in FIG. 1) and as the bag holder 1 (as shown in FIG. 1) is loaded with bags (or any kind of load) as the pressure of the force of gravity of the load may put on the bag holder 1 (as shown in FIG. 1) on one end, and the pressure that a hand 50 may put on the bag holder 1 (as shown in FIG. 1). As the base support 2 holds most of the pressure along with handles 8*a* and 8*b*, and when loaded with bags 70 handles 72 (as shown in FIG. 1) connected to the base support 2 hook, hanger 7.

Axle 4*a* and 4*b* may be configured as a ring that may be connected to handles 8*a* and 8*b*(as handles 8*a* and 8*b* may be configured to have connection holes instead of tabs axis's 12*a* and 12*b*) bars, axis's 12*a* and 12*b* via pin's, screws, etc, etc.

Base support 2 axles 4*a* and 4*b* may be closed round axles 4*a* and 4*b*, and or 4*a* or 4*b*, and or 4*b* or 4*a*. And a closed round axle may comprise a cogwheel or a ratchet style Axles 4*a* and 4*b* (as handles 8*a* and 8*b* may comprise parts that may fit a cogwheel).

Base support 2 may comprise an extended tab on top of the base support 2 connection hole 14 and may be configured to open a cart (or trolley) lucking mechanism system.

Base support 2 may comprise a bottle opener shaped tab that may open bottles.

A base support 2 may be one or more parts coming together to form the base support 2 and the base support 2 may have a spring connection on the neck 44 that may connect hook, hanger 7 and the top of the base support 2 axles 4*a* and 4*b* that may be used to measure weight.

A base support 2 may comprise a connection of a laser flashlight, a knife, a bottle opener, etc, etc.

Base support 2 may comprise a plurality of axles 4*a* and 4*b*.

Base support 2 axles 4*a* and 4*b* may be a closed portion of axles and may comprise a cogwheel connection to axles 4*a* and 4*b* and or 4*a* or 4*b*.

Base support 2 may be configured to allow a connection of a plurality of tabs that may be configured as handles or as extensions of handles 8*a* and or 8*b*.

Base support 2 may be configured to have one axle 4 that may allow a connection of at least one handle 8 one side of the base support 2.

Base support 2 may comprise one connection axle 4*a* or 4*b* for the base support 2 and may allow a connection of a handle to the axle 4 as the other axle may be configured as a build in tab or handle.

FIG. 5 shows a bottom view of a handle 8*a* according to one embodiment of the present invention. A handle 8*a* comprises a bar, axis 12*a*, a tab 9*a*, a tab 9*c*, a tab 16*a*, a tab 16*c*, a gap 18*a*, gap 19*a* and a stoppage 15*a*.

A handle 8*a* may be made of any material such as metal, copper, steel, aluminum, plastic, etc, etc.

Handle 8*a* may be covered or combined with a soft material such as thermoplastic, lather, rubber, etc, etc for a soft grip once is connected to the bag holder 1 (as shown in FIGS. 1-2-3).

Handle 8*a* may a plurality of handle 8*a* and may be one part as shown in FIG. 5, or may be a number of parts connected together to form Handle 8*a*.

Handle 8*a* may comprise at least one bar, axis 12*a*.

A handle 8*a* may be in any shape or form, such as a round shape, a rectangular shape. An arched shape, etc, etc, preferably a handle 8*a* may be with rounded edges and a wavy shape for fingers of a hand to hold (as shown in FIG. 1 and FIG. 2).

A handle 8*a* may be in any size. And may be from approximately 2 cm-10 cm in length (when looking at the handle 8*a* horizontally as shown in FIG. 5) preferably from approximately 3 cm-8 cm in length, more preferably from approximately 4 cm-6 cm in length (looking at handle 8*a* as shown in FIG. 5 horizontally).

Handle 8*a* may be in any width from approximately 0.4 cm-5 cm wide. Preferably from approximately 0.5 cm-3 cm wide. More preferably from 1 cm-2 cm in width (looking at handle 8*a* as shown in FIG. 5*a* vertically).

A handle 8*a* may be in any height from approximately 0.2 cm-5 cm in height (looking at the handle 8*a* vertically as shown in FIG. 1 as a connected handle 8*a*) preferably from 0.5 cm-3 cm in height, more preferably from 1 cm-2 cm in height.

A Bar, axis 12*a* may be a round or flat portion that provides a sufficient structural integrity as to be able to withstand a great amount of pressure from external force without detaching from the base support 2 axle 12*a* once the handle 8*a* is connected to the base support 2 and is open at approximately 90 degrees from the base support 2 hook, hanger 7 (as shown in FIG. 1) and as the bag holder 1 (as shown in FIG. 1) is loaded with bags (or any kind of load) as the pressure of the force of gravity of the load may put on the bag holder 1 (as shown in FIG. 1) on one end, and the pressure that a hand 50 may put on the bag holder 1 (as shown in FIG. 1) on the other end, and as the handle 8*a* that is connected to the base support 2 axle 4*a* via bar, axis 12*a* is pulled upwards then the bar, axis 12*a* stoppage 5*a* of the handle 8*a* (described in FIG. 6) and the stoppage 5*c*(of the base support 2 as shown in FIG. 9) may also assist in inhibiting the detachment of the bar, axis 12*a* from the base support 2.

A bar, axis 12*a* may be in any size, diameter or form that may fit the axle 4*a* and allow a rotation upwards and downwards manually on the axle 4*a* (as shown in FIG. 9).

A handle 8*a* tabs 16*a* and 16*c* configured to allow a hook, hanger 7 to slide into tabs 16*a*, 16*c* once the handle 8*a* is folded down and is in the closed manner bag holder 1 (as shown in FIG. 3).

Handle 8*a* may comprise a plurality of tabs 16*a* and 16*c* and as tabs 16*a* and 16*c* may comprise tabs that may be connecting and closing tabs 16*a* and 16*c* with the base support 2 hook, hanger 7 as hook, hanger 7 may be configured to comprise slots (17*a* and 17*b* as shown in FIG. 9) that may fit tabs 16*a* and 16*c* inside the slots.

Handle 8*a* may be with or without tabs 16*a*, 16*c*. And or, may comprise one tab 16 for handle 8*a*.

Tabs 9*a* and 9*c* are configured as two walls that are connected to each other via bar, axis 12*a*, and as to allow a connection of a bar, axis 12*a* to the base support 2 via axle 4*a* and may allow movement of a handle 8*a* upwards and downwards on a base support 2 with respect to the base support 2 axle 4*a*.

Handle 8*a* tabs 9*a* and 9*c* may be configured to have a male and female connection path for each tab, meaning that on tab may be configured as a male tab and the other tab may be configured as a female tab.

Tabs 16*a*, 16*c* may be in any size or form that may fit a hook, hanger 7 and inside the gap 18*a*.

A gap 18*a* may be in any size or form that may allow a hook, hanger 7 to fit and close the tabs 16*a*, 16*c* on a base support 2 hook, hanger 7.

A handle 8*a* may be with or without the gap 18*a*.

Tabs 9*a*, 9*c* are connected to each other via bar, axis 12*a* and are having a gap that allows the base holder 2 axle 4*a* to fit and connect handle 8*a* bar, axis 12*a* to the base support 2 axle 4*a*.

Gap 19*a* is configured to allow the connection and the rotation of a the handle 8*a* bar, axis 12*a* on the base support 2 axle 4*a* and the stoppages 5*a* and 5*c* upwards and downwards once the handle 8*a* is connected to the base support 2 axle 4*a* (as shown in FIGS. 2 and 3 and closed and open manner bag holder 1). as the handle 8*a* gap 19*a* allows the stoppages 5*c*,5*a* to move (once in movement upwards and downwards) up and down and in and out of the gap 19*a*.

Handle 8*a* may comprise a single tab that may be centered on one end of the handle 8*a* and may be connected to the base support 2 (as shown in FIG. 9).

Handle 8*a* may comprise a single tab that may be centered on one end of the handle 8*a* and may be connected to the base support 2 via screw, pin or any kind of connection method.

Tabs 16*a* and 16*c* may comprise pins that may be connecting the handle 8*a* to the base support 2 hook, hanger 7.

A stoppage 15*a* may be in any shape or form and may be a stoppage that may be designed on the handle 8*a*, and or may be a stoppage that is as part of the shape of the handle 8*a* and is a stoppage that prevents from the handle 8*a* from moving further as the handle may 8*a* may provide a natural stoppage for the handle 8*a*.

Tab 9*a* may be configured to have a male or female connection path to it and tab 9*c* may be configured to have a male or female connection path to it.

Handle 8*a* Tab 9*a* may be configured as a male connection tab that may be connected to a handle 8*b* tab 9*b* as tab 9*b* may be configured as a female tab that as when both handles 8*a* and 8*b* may rotate upwards to become the open manner bag holder 1 (as shown in FIG. 2) then handle 8*a* tab 9*a* (male or giver) and handle 8*b* tab 9*b*(female or receiver) may connect to each other and allow handle 8*a* and handle 8*b* to stay open as open manner bag holder 1 until handles 8*a* and 8*b* may be pivoting downwards and tab 9*b* (female or receiver) may be exiting tab 9*a* (male or giver).

Both handles 8*a* and 8*b* may be configured to have one male and one female that may be connected on one side (front or rear) of the bag holder 1 as tab 9*a* may be connected to tab 9*b*(each tab may be male or female giving or receiving tabs) and tab 9*c*(of the handle 8*a*) may be connected to the tab 9*d*(each handle may be male or female and or giving and receiving), and or one handle may comprise a male (or giving) connection parts on both tabs and the other handle may comprise a female (or receiver) connection parts, and as both handles may open to form the open manner bag holder 1 then the tabs may connect to each other and form the open manner bag holder 1 handles 8*a* and 8*b*.

Handle 8*a* may be in any color such as: white, blue, pink, yellow, black, green, red, purple, etc, etc and may be a combination of colors.

Handle 8*a* may comprise a spring that may be connected to the bar, axis 12*a* for a handle 8*a* as a handle 8*a* may be connected to a base support 2 axle 4*a* as a spring may create a resistance between a base support 2 axle 4*a* and a handle 8*a* as handle 8*a* may be opening and closing with a spring creating a resistance as a handle 8*a* may want to go back (with the spring resistance) to a closed manner bag holder 1 (bag holder 1 is shown in FIG. 3). A spring resistance May be with an opening (as the open manner bag holder as shown in FIG. 2) or closing (as the closed manner bag holder 1 as shown in FIG. 3) of a handle 8*a* and may be connected to the base support 2 axle 4*a*, and or a base support 2 may be configured to have a spring connection that one side of a spring may be connected to the base support 2 and the other side of a spring may be connected to a handle 8*a* bar, axis 12*a* and or, to a tab 9*a* or tab 9*c* and or both tabs 9*a* and 9*c*.

Gap 19*a* may be in any size and is configured to allow base support 2 stoppage 5*c* to fit in the gap 19*a* once the bag holder is closing to form a closed manner bag holder 1 as shown in FIG. 4. meaning that as handle 8*a* folds from an open position bag holder as shown in FIG. 3 to a closed manner bag holder 1 and as handle 8*a* is in movement downwards then a stoppage 5*c* gets into the gap 19*a* and allows the folding of handle 8*a* from an open manner bag holder 1 as shown in FIG. 2 into a closed manner bag holder 1 as shown in FIG. 3.

Handle 8*a* bar, axis 12*a* may comprise a ring that may cover handle 8*a* bar, axis 12*a* and when connected to the base support 2 axle 4*a* may create a resistance of a pulled back mechanism.

Handle 8*a* may comprise a plurality of tab 9 (*a* or *c*), as tab 9 may comprise a bar, axis 12*a* that may be connected to handle 8*a* tab 9 that may be connected to the base support 2 axle 4*a* via pin, screw etc, etc and may produce a sufficient amount of strength under pressure once in use.

Handle 8*a* may comprise at least one tab 9*a* or 9*c* for the handle 8*a*. Handle 8*a* may comprise a plurality of tab 16 for the handle 8*a*, and handle 8*a* may be configured with or without tab 16 (*a* or *c*). Handle 8*a* may be a one part and or may comprise few parts that may be connected together to form a handle 8*a*.

Handle 8*a* may be configured as a halve handle of the bag holder (as shown in FIG. 2) and together with another halve handle 8*b* (described in FIGS. 6*a* and 6*b*) connected to the base support 2 (as shown in FIG. 2) and opened as the open manner bag holder 1 as shown in FIG. 2 may form a one long handle for the bag holder as shown in FIG. 2.

FIG. 6 shows a top view of a handle 8*a* according to one embodiment of the present invention and is not intended to limit the scope of the present invention. A handle 8*a* comprises: a handle 8*a*, a gap space 34*a*, a stoppage 15*a*, a tab 9*a*, a tab 9*c*, a bar, axis 12*a*.

A top side of a handle 8*a* may be in any shape or form, such as a straight line and may be narrower then the bottom of the handle 8*a* (where the hand is holding the handle 8*a*) as the bottom of the handle 8*a* may be wider for a wide grip or hold of a hand 50 (a hand 50 is described in FIG. 1).

A gap, space 34*a* may be in any size, length or form and may comprise a connection hole or a snap spring path that may allow a connection of other parts such as: a knife, a nail buffer, a screwdriver, a bottle opener, etc, etc.

A stoppage 15*a* is configured to prevent from the handle 8*a* to move more then approximately 90 degrees from the hook, hanger 7 when the bag holder is in the open manner 1 (as shown in FIGS. 1-2), and as a handle 8*a* may be lifted with any kind of load.

A bar, axis 12*a* is connecting tab 9*a* and a tab 9*c*, and as tab 9*a* and tab 9*c* are covering and holding the connection of a bar, axis 12*a* to the base support 2 via axle 4*a* as a bar, axis 12*a* is a bridge connecting tab 9*a* and tab 9*b* of a handle 8*a*.

Tab 9*a* and tab 9*c* may be in any shape or form.

Tab 9*a* and tab 9*c* may comprise a connection hole that may be instead of a bar, axis 12*a* and may be connected to the base support 2 via pin, screw or anything that may connect the handle 8*a* to the base support 2.

Handle 8*a* may comprise at least one tab 9 for the handle 8*a* that may be connected to the base support 2 axle 4*a*.

Handle 8*a* may comprise a cogwheel that may be as part of the bar, axis 12*a* and or, may be instead of the bar, axis 12*a*, and or a cogwheel shaped tab 9*s* 9*a* and 9*b* that when connected to handle 8*b* and one cogwheel into the other (handles 8*a* and 8*b* tabs 9*a*, 9*c*, 9*b*, 9*d* into one another) may provide a mechanism that when one handle is being moved upwards or downwards then the other handle may move automatically upwards and downwards with the other handle (8*a* or 8*b*).

A stoppage 15*a* may be in any shape or form and may be a stoppage that may be designed on the handle 8*a*, and or may be a stoppage that is as part of the shape of the handle 8*a* and is a stoppage that prevents from the handle 8*a* from moving further upwards as the handle may 8*a* may provide a natural stoppage for the handle 8*a* with the stoppage 5*a* that the base support 2 comprises.

Both handles 8*a* and 8*b* (described in FIGS. 5 and 6) are configured as halve handle each that when open up and as a straight line as shown in FIG. 2 form a one long handle. As Handle 8*a* is a halve handle that when opens up from the closed manner bag holder 1 and into an open manner bag holder 1 a handle 8*a* in itself provides a halve handle and as handle 8*a* opens up from the closed manner bag holder 1 and turns into the open manner bag holder 1 provides the other halve of the bag holder 1 and when both handles 8*a* and 8*b* connected to the base support 2 and together with the base support 2 and in an open manner bag holder 1 (as shown in FIGS. 1-2) are providing a wide handle for a hand 50 to hold as shown in FIG. 1.

FIG. 7 shows a bottom view of a handle 8*b* according to one embodiment of the present invention. A handle 8*b* comprises a bar, axis 12*b*, a tab 9*b*, a tab 9*d*, a tab 16*b*, a tab 16*d*, a gap 18*b*, gap 19*b* and a stoppage 5*b*.

A handle 8*b* may be made of any material such as metal, copper, steel, aluminum, plastic, etc, etc.

Handle 8*b* may be covered or combined with a soft material such as thermoplastic, lather, rubber, etc, etc for a soft hold once is connected to the bag holder 1 (as shown in FIGS. 1-2-3).

Handle 8*b* may a plurality of handle 8*b* and may be one part as shown in FIG. 6*a*, or may be a number of parts connected together to form Handle 8*b*.

Handle 8*b* may comprise at least one bar, axis 12*b*.

A handle 8*b* may be in any shape or form, such as a round shape, a rectangular shape. An arched shape, etc, etc, preferably a handle 8*b* may be with rounded edges and a wavy shape for fingers of a hand 50 to hold (as shown in FIG. 1 and FIG. 2).

A handle 8*b* may be in any size. And may be from approximately 2 cm-10 cm in length (when looking at the handle 8*b* horizontally as shown in FIG. 6*a*) preferably from approximately 3 cm-8 cm in length, more preferably from approximately 4 cm-6 cm in length (looking at handle 8*b* as shown in FIG. 6*a* horizontally).

Handle 8*b* may be in any width from approximately 0.4 cm-5 cm wide. Preferably from approximately 0.5 cm-3 cm wide. More preferably from 1 cm-2 cm in width (looking at handle 8*b* as shown in FIG. 6*a* vertically).

A handle 8*b* may be in any height from approximately 0.2 cm-5 cm in height (looking at the handle 8*b* vertically as shown in FIG. 1 as a connected handle 8*b*) preferably from 0.5 cm-3 cm in height, more preferably from 1 cm-2 cm in height.

A Bar, axis 12*b* may be a round or flat portion that provides a sufficient structural integrity as to be able to withstand a great amount of pressure from external force without detaching from the base support 2 axle 12*b* once the handle 8*b* is connected to the base support 2 and is open at approximately 90 degrees from the base support 2 hook, hanger 7 (as shown in FIG. 1) and as the bag holder (as shown in FIG. 1) is loaded with bags (or any kind of load) as the pressure of the force of gravity of the load may put on the bag holder (as shown in FIG. 1) on one end, and the pressure that a hand 50 may put on the bag holder 1 (as shown in FIG. 1) on the other end, and as the handle 8*b* that is connected to the base support 2 axle 4*b* via bar, axis 12*b* is pulled upwards then the bar, axis 12*b* stoppage 15*b* of the handle 8*b* (described in FIG. 6*b*) and the stoppage 5*d* (of the base support 2 as shown in FIG. 9) may also assist in inhibiting the detachment of the bar, axis 12*b* from the base support 2.

A bar, axis 12*b* may be in any size, diameter or form that may fit the axle 4*b* and allow a rotation upwards and downwards manually on the axle 4*b* (as shown in FIG. 9).

A handle 8*b* tabs 16*b* and 16*d* configured to allow a hook, hanger 7 to slide into tabs 16*b*, 16*d* once the handle 8*b* is folded down and is in the closed manner bag holder 1 (as shown in FIG. 3).

Handle 8*b* may be with or without tabs 16*b*, 16*d*. And or, may comprise one tab 16 for handle 8*b*.

Tabs 9*b* and 9*d* are configured as two walls that are connected to each other via bar, axis 12*b*, and as to allow a connection of a bar, axis 12*b* to the base support 2 via axle 4*b* and may allow movement of a handle 8*b* upwards and downwards on a base support 2 with respect to the base support 2 axle 4*b*.

Handle 8*b* tabs 9*b* and 9*d* may be configured to have a male and female connection path for each tab, meaning that on tab may be configured as a male tab and the other tab may be configured as a female tab.

Tabs 16*b*, 16*d* may be in any size or form that may fit a hook, hanger 7 and inside the gap 18*b*.

A gap 18*b* may be in any size or form that may allow a hook, hanger 7 to fit and close the tabs 16*b*, 16*d* on a base support 2 hook, hanger 7.

A handle 8*b* may be with or without the gap 18*b*.

Tabs 9*b*, 9*d* are connected to each other via bar, axis 12*b* and are having a gap that allows the base holder 2 axle 4*b* to fit and connect handle 8*b* bar, axis 12*b* to the base support 2 axle 4*b*.

Gap 19*b* is configured to allow the connection and the rotation of a the handle 8*b* bar, axis 12*b* on the base support 2 axle 4*b* and the stoppages 5*b* and 5*d* upwards and downwards once the handle 8*b* is connected to the base support 2 axle 4*b* (as shown in FIGS. 2 and 3 and closed and open manner bag holder 1). as the handle 8*b* gap 19*b* allows the stoppages 5*b*,5*d* to move (once in movement upwards and downwards) up and down and in and out of the gap 19*b*.

Handle 8*b* may comprise a single tab that may be centered on one end of the handle 8*b* and may be connected to the base support 2 (as shown in FIG. 9). Handle 8*b* may comprise a single tab that may be centered on one end of the handle 8*b* and may be connected to the base support 2 via screw, pin or any kind of connection method.

Tabs 16*b* and 16*d* may comprise pins that may be connecting the handle 8*b* to the base support 2 hook, hanger 7.

A stoppage 15*b* may be in any shape or form and may be a stoppage that may be designed on the handle 8*b*, and or may be a stoppage that is as part of the shape of the handle 8*b* and is a stoppage that prevents from the handle 8*b* from moving further as the handle may 8*b* may provide a natural stoppage for the handle 8*b*.

Tab 9*b* may be configured to have a male or female connection path to it; and as tab 9*d* may be configured to have a male or female connection path to it.

Handle 8*b* Tabs 9*b*, 9*d* may be configured as a male connection tab that may be connected to a handle 8*a* tab 9*a* as tab 9*c* may be configured as a female tab that as when both handles 8*a* and 8*b* may rotate upwards to become the open manner bag holder 1 (as shown in FIG. 2) then handle 8*a* tab 9*a* (male or giver) and handle 8*b* tab 9*b* (female or receiver) may connect to each other and allow handle 8*a* and handle 8*b* to stay open as open manner bag holder 1 until handles 8*a* and 8*b* may be pivoting downwards and tab 9*b* (female) may be exiting tab 9*a* (male).

Both handles 8*a* and 8*b* may be configured to have one male and one female that may be connected on one side (front or rear) of the bag holder 1 as tab 9*b* may be connected to tab 9*a*(each tab may be male or female giving or receiving tabs) and tab 9*d*(of the handle 8*a*) may be connected to the tab 9*c*(each handle may be male or female and or giving and receiving), and or one handle may comprise a male (or giving) connection parts on both tabs and the other handle may comprise a female (or receiver) connection parts, and as both handles may open to form the open manner bag holder 1 then the tabs may connect to each other and form the open manner bag holder 1 handles 8*a* and 8*b*.

Handle 8*b* may be in any color such as: white, blue, pink, yellow, black, green, red, purple, etc, etc and may be a combination of colors.

Handle 8*b* may comprise a spring that may be connected to the bar, axis 12*b* for a handle 8*b* as a handle 8*b* may be connected to a base support 2 axle 4*b* as a spring may create a resistance between a base support 2 axle 4*b* and a handle 8*b* as handle 8*b* may be opening and closing with a spring creating a resistance as a handle 8*b* may want to go back (with the spring resistance) to a closed manner bag holder 1 (bag holder 1 is shown in FIG. 3). A spring resistance May be with an opening (as the open manner bag holder as shown in FIG. 2) or closing (as the closed manner bag holder as shown in FIG. 3) of a handle 8*b* and may be connected to the base support 2 axle 4*b*, and or a base support 2 may be configured to have a spring connection that one side of a spring may be connected to the base support 2 and the other side of a spring may be connected to a handle 8*b* bar, axis 12*b* and or, to a tab 9*b* or tab 9*d* and or both tabs 9*b* and 9*d*.

Gap 19*b* may be in any size and is configured to allow base support 2 stoppage 5*d* to fit in the gap 19*b* once the bag holder is closing to form a closed manner bag holder 1 as shown in FIG. 4. meaning that as handle 8*b* folds from an open position bag holder 1 as shown in FIG. 3 to a closed manner bag holder 1 and as handle 8*b* is in movement downwards then a stoppage 5*d* gets into the gap 19*b* and allows the folding of handle 8*b* from an open manner bag holder as shown in FIG. 2 into a closed manner bag holder 1 as shown in FIG. 3.

Handle 8*b* bar, axis 12*b* may comprise a ring that may cover handle 8*b* bar, axis 12*b* and when connected to the base support 2 axle 4*b* may create a resistance of a pulled back mechanism.

Handle 8*b* may comprise a plurality of tab 9 (*b* or *d*), as tab 9 may comprise a bar, axis 12*b* that may be connected to handle 8*b* tab 9 that may be connected to the base support 2 axle 4*b* via pin, screw etc, etc and may produce a sufficient amount of strength under pressure once in use.

Handle 8*b* may comprise at least one tab 9*b* or 9*d* for the handle 8*d*.

Handle 8*b* may comprise a plurality of tab 16 for the handle 8*b*, and handle 8*b* may be configured with or without tab 16 (*b* or *d*).

Handle 8*b* may be a one part and or may comprise few parts that may be connected together to form a handle 8*b*.

Handle 8*b* may be configured as a halve handle of the bag holder 1 (as shown in FIG. 2) and together with another halve handle 8*a* (described in FIGS. 5 and 6) connected to the base support 2 (as shown in FIG. 2) and opened as the open manner bag holder 1 as shown in FIG. 2 may form a one long handle for the bag holder 1 as shown in FIG. 2.

Figure 8:
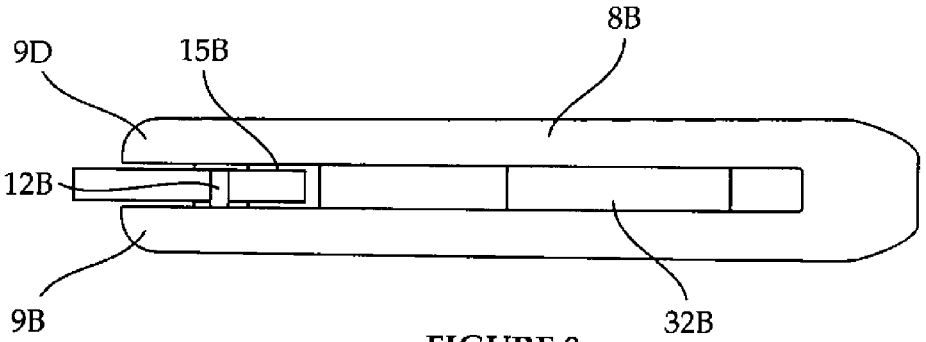
FIG. 8 is a top view of the handle (8*b*).

FIG. 8 shows a top view of a handle 8*b* according to one embodiment of the present invention and is not intended to limit the scope of the present invention. A handle 8*b* comprises: a handle 8*b*, a gap space 34*b*, a stoppage 15*b*, a tab 9*b*, a tab 9*d*, a bar, axis 12*b*.

A top side of a handle 8*b* may be in any shape or form, such as a straight line and may be narrower then the bottom of the handle 8*b* (where the hand is holding the handle 8*b*) as the bottom of the handle 8*b* may be wider for a wide grip or hold of a hand 50 (a hand 50 is described in FIG. 1).

A gap, space 34*b* may be in any size, length or form and may comprise a connection hole or a snap spring path that may allow a connection of other parts such as: a knife, a nail buffer, a screwdriver, a bottle opener, etc, etc.

A stoppage 15*b* is configured to prevent from the handle 8*b* to move more then approximately 90 degrees from the hook, hanger 7 when the bag holder 1 is in the open manner (as shown in FIGS. 1-2), and as a handle 8*b* may be lifted with any kind of load.

A bar, axis 12*b* is connecting tab 9*b* and a tab 9*d*, and as tab 9*b* and tab 9*d* are covering and holding the connection of a bar, axis 12*b* to the base support 2 via axle 4*b* as a bar, axis 12*b* is a bridge connecting tab 9*b* and tab 9*d* of a handle 8*b*.

Tab 9*b* and tab 9*d* may be in any shape or form.

Tab 9*b* and tab 9*d* may comprise a connection hole that may be instead of a bar, axis 12*b* and may be connected to the base support 2 via pin, screw or anything that may connect the handle 8*b* to the base support 2.

Handle 8*b* may comprise at least one tab 9 for the handle 8*b* that may be connected to the base support 2 axle 4*b*.

Handle 8*b* may comprise a cogwheel that may be as part of the bar, axis 12*b* and or, may be instead of bar, axis 12*b*, and or, a cogwheel shaped tabs 9, 9*b* and 9*d* that when connected to handle 8*a* and one cogwheel into the other (handles 8*a* and 8*b* tabs 9*a*, 9*b*, 9*c* 9*d* into one another) may provide a mechanism that when one handle is being moved upwards or downwards then the other handle may move automatically upwards and downwards with the other handle (8*a* or 8*b*).

A stoppage 15*b* may be in any shape or form and may be a stoppage that may be designed on the handle 8*b*, and or may be a stoppage that is as part of the shape of the handle 8*b* and is a stoppage that prevents from the handle 8*b* from moving further upwards as the handle may 8*b* may provide a natural stoppage for the handle 8*b* with the stoppage 5*b* that the base support 2 comprises.

Both handles 8*a* and 8*b* (described in FIGS. 7 and 8) are configured as halve handle each that when open up and as a straight line as shown in FIG. 2 form a one long handle. As Handle 8*b* is a halve handle that when opens up from the closed manner bag holder 1 and into an open manner bag holder 1 a handle 8*b* in itself provides a halve handle and as handle 8*b* opens up from the closed manner bag holder 1 and turns into the open manner bag holder 315 provides the other halve of the bag holder 1 and when both handles 8*a* and 8*b* connected to the base support 2 and together with the base support 2 and in an open manner bag holder 1 (as shown in FIGS. 1-2) are providing a wide handle for a hand 50 to hold as shown in FIG. 1.

FIG. 9 shows a front view of a closed manner bag holder 1 according to one embodiment of the present invention, and is not intended to limit the scope of the present invention. A closed manner bag holder 1 comprises all the elements described in FIG. 2-6*b* with one side of handles 8*a* and 8*b* exposed and without one tab 9 (9*a* or 9*c*) and one tab 16 (16*a* or 16*c*) of handle 8*a* and without one tab 9 (9*b* or 9*d*) and one tab 16 (16*b* or 16*d*) of handle 8*b* and with folded handles 8*a* and 8*b* and touching base support 2 hook, hanger 7. a folded manner bag holder 1 comprises a base support 2, a handle 8*a*, a handle 8*b*, a connection hole 14, a stoppage 5*a*, a stoppage 5*b*, an axle 4*a*, an axle 4*b*, a bar, axis 12*a*, tab 9 (9*a* or 9*c* of handle 8*a*), a bar, axis 12*b*, tab 9 (9*b* or 9*d* of handle 8*b*), a stoppage 5*c*, a stoppage 5*d*, tab 16 (16*a* or 16*c* of handle 8*a*), tab 16 (16*b* or 16*d* of handle 8*b*) a slot 17*a*, a slot 17*b*, a hook, hanger 7 and a hook tab 6.

A stoppage 15*b* may be in any shape or form and may be a stoppage that may be designed on the handle 8*b*, and or may be a stoppage that is as part of the shape of the handle 8*b* and is a stoppage that prevents from the handle 8*b* from moving further as the handle may 8*b* may provide a natural stoppage for the handle 8*b*.

A closed manner bag holder 1 shows a bag holder in a closed manner 1 with one side of handles 8*a*, 8*b* exposed and connected to the base support 2 axles via bar, axis 12*a* of the handle 8*a*, and via bar, axis 12*b* for the handle 8*b*. Comprising: handles 8*a*, handle 8*b*, a bar, axis 12*a*, a bar axis 12*b*, a base support 2, an axle 4*a*, and an axle 4*b*.

A closed manner bag holder 1 may be in any shape or form, such as round shape, square shape, rectangular shape, etc, etc. A closed manner bag holder 1 may be made of any material such as metal, copper steel, plastic, etc, etc. and may also be made of a combination of materials such as, the handles 8*a*, 8*b* may be made of plastic and the base support 2 may be made of aluminum or any other material (for example).

Slots 17*a*, 7*b* may be in any shape or form that may allow pins of the handles 8*a* and 8*b* pins (assuming handles 8*a* and 8*b* provide pins that may slide into slots 17*a* and 17*b*) to slide inside slots 17*a* and 17*b* and connect to hold the handles 8*a* and 8*b* to the base support 2 hook, hanger 7.

Base support 2 may comprise a plurality of slots 17*a* and 17*b* and may be with or without slots 17*a* and 17*b* for the base support 2.

Handles 8*a* and 8*b* bars, axis's 12*a* and 12*b* may be connected to the base support 2 axles 4*a* and 4*b* by force and may click once connected to axles 4*a* and 4*b* and as tabs 9*a*, 9*c* of handle 8*a* may be configured to support bar, axis 12*a* and tabs 9*b* and 9*d* may be configured to support bar, axis 12*b* of handle 8*b*.

A bag holder 1 as shown in FIGS. 2 and 3 may comprise one tab 9 for each handle 8*a* and 8*b* that may support the connection of a bar, axis 12*a* for handle 8*a* and a bar, axis 12*b* for handle 8*b*, and may be handle 8*a* with a tab 9 and a bar, axis 12*a* coming out of handle 8*a* tab 9 that may be connected to the base support 2 axle 4*a* and as bar, axis 12*a* may comprise a rail that may prevent bar, axis 12*a* to slide out of axle 4*a* once connected, and or, bar axis 12*a* may comprise a screw path that may be closed with the base support 2 axle 4*a* with a screw that may be attaching tab 9 bar, axis 12*a* to the base support 2 as the bar, axis 12*a* may be connected to axle 4*a*, and may be handle 8*b* with a tab 9 and a bar, axis 12*b* coming out of handle 8*b* tab 9 that may be connected to the base support 2 axle 4*b* and as bar, axis 12*b* may comprise a rail that may prevent bar, axis 12*b* to slide out of axle 4*b* once connected, and or, bar axis 12*b* may comprise a screw path that may be closed with the base support 2 axle 4*b* with a screw that may be attaching tab 9 bar, axis 12*b* to the base support 2 as the bar, axis 12*b* may be connected to axle 4*b*. A one tab 9 (*a* and *b*) for each handle 8*a* and 8*b* may comprise all the elements described in FIG. 9 and may be as shown in FIG. 9 and may comprise pins or screws that may connect bars, axis's 12*a* and 12*b* to the base support 2 and may achieve the mechanism for handles 8*a* and 8*b* bars, axis's 12 and 12*b* that may be rotating on the base support 2 axles 4*a* and 4*b* without detaching from the base support 2 when handles 8*a* and 8*b* in movement on the base support 2 axles 4*a* and 4*b*.

Figure 10:
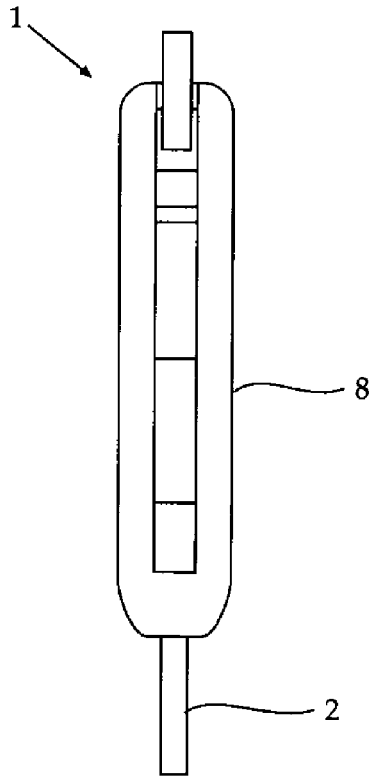
FIG. 10 is a side view of the bag holder (1) in a closed position.

FIG. 10 shows a side view of a closed manner bag holder 1. Comprises, handle 8 and base support 2.

Figure 11:
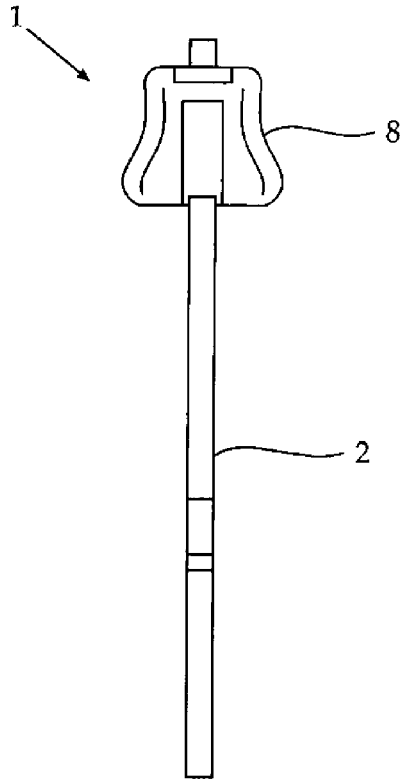
FIG. 11 is a side view of the bag holder (1) in an opened position.

FIG. 11 shows a side view of an open manner bag holder 1. Comprises, a handle 8 and a base support 2.

Figure 12:
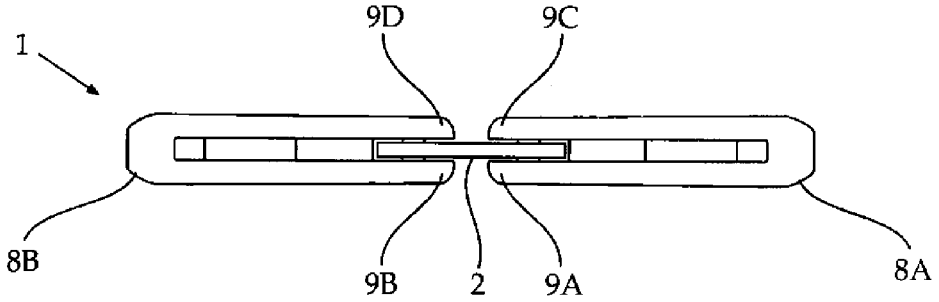
FIG. 12 is a top view of the bag holder (1) in a closed position.

FIG. 12 shows a top view of a bag holder in an open manner 1 with handle 8*a* and handle 8*b* connected to a base support 2. Comprising, a handle 8*a*, a handle 8*b*, a base support 2, a tab 9*a*, a tab 9*b*, a tab 9*c*, a tab 9*d*.

An open manner bag holder 1 may be in any shape or form.

An open manner bag holder may be in any size from approximately 4 cm-20 cm in length (looking at the open manner bag holder 1 horizontally). Preferably from approximately 6 cm-15 cm in length (looking at the open manner bag holder 1 horizontally) more preferably from 8 cm-12 cm in length (looking at the open manner bag holder 1 horizontally).

An open manner bag holder 1 may be in any width from approximately 0.1 cm-5 cm in width, preferably from 0.5 cm-3 cm in width, more preferably from 0.8 cm-1.5 cm in width (looking at the open manner bag holder 1 vertically).

FIG. 13 shows a top view of a closed manner bag holder 1 with handles 8*a* and 8*b* closed, comprising, a base support 2, a handle 8*a*, a handle 8*b*.

A closed manner bag holder 1 may be in any shape or form.

A closed manner bag holder 1 may be in any size from 1.0 cm-10 cm in length. Preferably from approximately 2 cm-6 cm in length. More preferably from 2.5 cm-3.5 cm in length (looking at the closed manner bag holder 1 horizontally).

A closed manner bag holder 1 may be in any width from approximately 0.1 cm-5 cm in width, preferably from 0.5 cm-3 cm in width, more preferably from 0.8 cm-1.5 cm in width (looking at the closed manner bag holder 1 vertically).

In operation, assuming that a bag holder is in a closed manner as bag holder 1 as shown in FIG. 3 and without a key ring a (a key ring may be an addition to the closed manner bag holder 1 as shown in FIG. 3) and opening to become the open manner bag holder 1 as shown in FIG. 2, as a bag holder is in a closed manner bag holder 1 (as shown in FIG. 3) and opening to become an open manner bag holder 1 as shown in FIG. 2, and as the open manner bag holder 1 is held by a hand 50 (shown in FIG. 1) and with bag 70 handles 72 inside the bag holder as shown in FIG. 1, and as the bag holder with the bag 70 connected to the bag holder by the bag 70 bag handles 72 and held by the hand 50 makes the bag holder into a bag holder as shown in FIG. 1. the bag holder 1 will be described as two sides (or halves) that one side (or halve) describes the mechanism of the handle 8A on one side of the base support 2, and another side (or halve) that describes the mechanism of the handle 8B on the other side of the base support 2, as both sides (handles 8*a* and 8*b* and the base support 2) make the bag holder in the open manner bag holder 1 as shown in FIG. 1 and FIG. 2 and both sides (handles 8*a* and 8*b* and the base support 2) make the closed manner bag holder as shown in FIG. 3, as both sides handles 8*a* and 8*b* connected to the base support 2 on one side of the handle 8*a* and one side of the handle 8*b* and move sideways and upwards and sideways and downwards on the base support 2 axles 4*a* and 4*b*, (axle 4*a* for the handle 8*a* bar, axis 12*a* and on the base support 2 axle 4*b* for the handle 8*b* bar, axis 12*b*) and as both handles 8*a* and 8*b* may be moved manually upwards and downwards together or separately.

In Operation First Side Handle 8A Opening from a Closed Manner Bag Holder 1 into an Open Manner As a hand 50 pulls handle 8*a* sideways as handle 8*a* tabs 9*a* and 9*c* are moving towards the connection hole 14 and as hook, hanger 7 slide out of the handle 8*a* tabs 16*a* and 16*c* and as hook hanger 7 is getting out of the handle 8*a* gap 18*a* and as handle 8*a* bar, axis 12*a* is pivoting (rotating or sliding) on the base support 2 axle 4*a*, and as handle 8*a* is lifted sideways and all the way upwards and rotating with respect to the base support 2 axle 4*a*, until handle 8*a* stoppage 15*a* reaches the base support 2 stoppage 5*a* and as handle 8*a* stoppage 15*a* clicks with the base support 2 stoppage 5*a* that holds the handle 8*a* in an open position (handle 8*a* opens at approximately 90 degrees from the base support 2 hook, hanger 7) and one side of the bag holder 1 is formed and is an open handle 8*a* as shown in FIG. 2 and as one side of the bag holder 1.

In Operation First Side Handle 8A Folding from an Open Manner Bag Holder 1 into a Closed Manner And As a hand 50 pulls handle 8*a* from the open manner bag holder 1 sideways and downwards as handle 8*a* stoppage 15*a* is detaching from the base support 2 stoppage 5*a* and as handle 8*a* tabs 9*a* and 9*c* are moving towards the stoppage 5*a* of the base support 2 and as stoppage 5*c* slides (or moves) into the handle 8*a* gap 19*a* and as handle 8*a* stoppage 15*a* is detaching from the base support 2 stoppage 5*a* and as handle 8*a* stoppage 15*a* clicks from detaching from the base support 2 stoppage 5*a* and as handle 8*a* bar, axis 12*a* is rotating downwards with respect to the base support 2 axle 4*a* and as handle 8*a* is pivoting sideways and pushed all the way downwards as the stoppage 5*c* moves into handle 8*a* gap 19*a* and as handle 8*a* tabs 16*a* and 16*c* slide into the base support 2 hook, hanger 7 as hook, hanger 7 slides into the handle 8*a* gap 18*a* and one side of the closed manner bag holder 1 is achieved.

In Operation Second Side Handle 8B Opening from a Closed Manner Bag Holder 1 into an Open Manner As a hand 50 pulls handle 8*b* sideways as handle 8*b* tabs 9*b* and 9*d* are moving towards the connection hole 14 and as hook, hanger 7 slide out of the handle 8*b* tabs 16*b* and 16*d* and as hook hanger 7 is getting out of the handle 8*b* gap 18*b* and as handle 8*b* bar, axis 12*b* is pivoting (rotating or sliding) on the base support 2 axle 4*b*, and as handle 8*b* is lifted sideways and all the way upwards and rotating with respect to the base support 2 axle 4*b*, until handle 8*b* stoppage 15*b* reaches the base support 2 stoppage 5*b* and as handle 8*b* stoppage 15*b* clicks with the base support 2 stoppage 5*b* that holds the handle 8*b* in an open position (handle 8*b* opens at approximately 90 degrees from the base support 2 hook, hanger 7) and one side of the bag holder 1 is formed and is an open handle 8*b* as shown in FIG. 2 and as one side of the bag holder 1.

In Operation Second Side Handle 8B Folding from an Open Manner Bag Holder 1 into a Closed Manner And As a hand 50 pulls handle 8*b* from the open manner bag holder 1 sideways and downwards as handle 8*b* stoppage 15*b* is detaching from the base support 2 stoppage 5*b* and as handle 8*b* tabs 9*b* and 9*d* are moving towards the stoppage 5*b* of the base support 2 and as stoppage 5*d* slides (or moves) into the handle 8*b* gap 19*b* and as handle 8*b* stoppage 15*b* is detaching from the base support 2 stoppage 5*b* and as handle 8*b* stoppage 15*b* clicks from detaching from the base support 2 stoppage 8*b* and as handle 8*b* bar, axis 12*b* is rotating downwards with respect to the base support 2 axle 4*b* and as handle 8*b* is pivoting sideways and pushed all the way downwards as the stoppage 5*d* moves into handle 8*b* gap 19*b* and as handle 8*b* tabs 16*b* and 16*d* slide into the base support 2 hook, hanger 7 as hook, hanger 7 slides into the handle 8*b* gap 18*b* and one side of the closed manner bag holder 1 is achieved.

In Operation First and Second Sides Handle 8*a* and Handle 8*b*

As both sides of the bag holder (1), handle 8*a*(as a halve handle 8*a*) and handle 8*b*(as a halve handle 8*b*) connected to the base support 2 axles 4*a* and 4*b* via bar, axis 12*a* (of the handle 8*a* as bar, axis 12*a* is supported by tab 9*a* and 9*c* that are part of handle 8*a*) and bar, axis 12*b* (of the handle 8*b* as bar, axis 12*b* is supported by tab 9*b* and tab 9*d* that are part of handle 8*b*), and as both handles 8*a* and 8*b* are connected to the base support 2 and pulled upwards by hand 15 and rotating upwards from the closed manner bag holder 1 to the open manner bag holder 1 and form a long handle, that makes the open manner bag holder (as shown in FIG. 2), and when both handles 8*a* and 8*b* are pulled downwards and all the way to the base support 2 hook, hanger 7 and the closed manner bag holder (as shown in FIG. 3) is formed.

In Operation from a Closed Manner Bag Holder 1 as Shown in FIG. 3 to an Open Manner As a hand 50 is holding the bag holder as in the closed manner bag holder 1 (as shown in FIG. 3) and as a hand 50 is pulling (by force) handle 8*a* that is in a closed position as handle 8*a* tab 16*c* and tab 16*a* are connected to the base support 2 hook, hanger 7 and as the hook, hanger 7 is inside the handle 8*a* gap 18*a* and as a closed handle 8*a* shown in FIG. 3, and as a hand 50 is pulling the handle 8*a* sideways and upwards from the base support 2 hook, hanger 7 as the handle 8*a* tabs 16*a* and 16*c* are sliding out of the base support 2 hook, hanger 7 and the hook, hanger 7 is exiting the gap 18*a* of the handle 8*a* as the handle 8*a* bar, axis 12*a* is pivoting (rotating or sliding) on the base support 2 axle 4*a* And as the handle 8*a* is in movement upwards as the gap 19*a* is allowing the handle 8*a* bar, axis 12*a* to rotate on base support 2 stoppages 5*a* and 5*c*(as the stoppages 5*a* and 5*c* are holding the handle 8*a* bar, axis 12*a*) and as handle 8*a* is in movement sideways and all the way upwards until the handle 8*a* stoppage 15*a* reaches the base support 2 stoppage 5*a* as handle 8*a* opens approximately 90 degrees from the base support 2 hook, hanger 7 as shown in FIG. 2, that makes the opening of the handle 8*a* from the base support 2 hook, hanger 7 and from the closed manner bag holder as shown in FIG. 3 and all the way upwards to the base support 2 stoppage 5*a* and as a one side of the bag holder open from the closed position bag holder (a closed manner bag holder is shown in FIG. 3) into the open position bag holder (as one side of the open manner bag holder as shown in FIG. 2). And as a hand 50 is holding the bag holder as in the closed manner bag holder 1 (a closed manner bag holder 1 as shown in FIG. 3) and with one handle 8*a* open and one handle 8*b* closed, and as a hand 50 is pulling (by force) handle 8*b* that is in a closed position as handle 8*b* tab 16*b* and tab 16*d* are connected to the base support 2 hook, hanger 7 and as the hook, hanger 7 is in the handle 8*b* gap 18*b* and as a closed manner handle 8*b* as shown in FIG. 3 (one side of the bag holder) and lifting the handle 8*b* upwards as the handle 8*b* bar, axis 12*b* is pivoting (or rotating or sliding) with respect to the base support 2 axle 4*b* and on the base support 2 axle 4*b* And as the handle 8*b* is in movement upwards as the gap 19*b* is allowing the handle 8*b* bar, axis 12*b* to rotate on base support 2 stoppages 5*b* and 5*d* (as the stoppages 5*b* and 5*d* are holding the handle 8*b* bar, axis 12*b*) and as handle 8*ab* is in movement sideways and all the way upwards until the handle 8*b* stoppage 15*b* reaches the base support 2 stoppage 8*b* and as handle 8*b* opens at approximately 90 degrees as shown in FIG. 2 (as another side), that makes the opening of the handle 8*b* from the base support 2 hook, hanger 7 to the stoppage 8*b* and as a one side of the bag holder from the closed position bag holder 1 (as shown in FIG. 3) and into an open position bag holder 1 (as one side of the open manner bag holder as shown in FIG. 2). And, as both sides of the bag holder handle 8*a* and handle 8*b* are lifted all the way upwards and are in an open position, that makes the open manner bag holder 1 as shown in FIG. 2.

In Operation from an Open Manner Bag Holder 1 as Shown in FIG. 2 to a Closed Manner.

As the bag holder is in an open position as an open manner bag holder 1 as shown in FIG. 2 and with the handles 8*a* and handle 8*b* in an open manner bag holder and in an approximately 180 degrees (looking at the bag holder horizontally as shown in FIG. 1 and FIG. 2) as a hand 50 (or hands) is pulling down (or pushing down) handles 8*a* and handle 8*b* (together or separately) that are connected to the base support 2 axles 4*a* and 4*b* via bar, axis 12*a* of the handle 8*a*(connected to the base support 2 axle 4*a*) and bar, axis 12*b*(connected to the base support 2 axle 4*b*), and as a hand 50 (or hands) is pulling down handles 8*a* and 8*b* as bar, axis 12*a*(of handle 8*a*) and bar, axis 12*b*(of handle 8*b*) are pivoting (or rotating) Downwards from approximately 180 degrees both handles 8*a* and 8*b* or from approximately 90 degrees each handle 8*a* and 8*b*, and as handles 8*a* and 8*b* stoppages 15*a*(handle 8*a*) and 15*b*(handle 8*b*) are detaching from the base support 2 stoppages 5*a*(handle 8*a*) and 5*b*(handle 8*b*) and as both handles 8*a* and 8*b* are pulled downwards and as handles 8*a* and 8*b* are in movement downwards and as bars, axis's 12*a* and 12*b* rotate downwards with respect to the base support 2 axles 4*a* and 4*b* causes stoppages 5*c* (for the handle 8*a*) and 5*d* (for the handle 8*b*) to move into the handles 8*a* and 8*b* gaps 19*a* and 19*b* and as the handles 8*a* and 8*b* are in movement downwards and all the way until reaching the base support 2 hook, hanger 7, and as the base support 2 hook hanger 7 slides into the handle 8*a* gap 18*a* and into tabs 16*a* and 16*c* and closes (or lucks) handle 8*a* with the base support 2 hook, hanger 7, achieving the closing of one handle 8*a* with the hook, hanger 7 and one side of the closed manner bag holder 1 (as shown in FIG. 3), and as the base support 2 hook hanger 7 slides into the handle 8*b* gap 18*b* and into tabs 16*b* and 16*d* and closes (or lucks) handle 8*b* with the base support 2 hook, hanger 7 achieving the closing of handle 8*b* with the hook hanger 7 and one side of the closed manner bag holder 1 (as shown in FIG. 3). And as both sides of the bag holder, handle 8*a* and handle 8*b* are closed and touching the base support 2 hook, hanger 7, a closed manner bag holder 1 is achieved As shown in FIG. 3.

In operation, (An opening and closing of the bag holder with holding the bag holder as in the closed position 1 as shown in FIG. 3 and opening to become the bag holder 1 as shown in FIG. 2 and as the opening and closing of the bag holder may be accomplished with one or two hands and assuming that the bag holder 1 is being opened with two hands as one hand is described as hand 50 and the other hand is described as hand for the description only and assuming that handles 8*a* and 8*b* start at point 0 (zero) degrees when the bag holder is in a closed manner bag holder as shown in FIG. 3 and opening at approximately 90 degrees each handle 8*a* and 8*b* to form the open manner bag holder 1 as shown in FIG. 2) as a hand 50 holds the bag holder 1 from the hook, hanger 7 and another hand pulls the handle 8*a* sideways and upwards causes handle 8*a* bar, axis 12*a* (and tabs 9*a* and 9*c* that are connecting bar, axis 12*a* of handle 8*a*) to rotate with respect to the base support 2 axle 4*a* as the base support 2 hook, hanger 7 slides out of the handle 8*a* gap 18*a* and as the movement of the handle 8*a* sideways and upwards causes handle 8*a* tabs 16*a* and 16*c* to detach from the hook, hanger 7 and as the handle 8*a* is in movement (by hand) sideways and upwards (and as the handle 8*a* gap 19*a* allows the bar, axis 12*a* and the base support 2 axle 4*a* stoppages 5*c*, 5*a* to hold handle Ha bar, axis 12*a* and rotate upwards to achieve one side of the open manner bag holder as shown in FIG. 2) and as handle 8*a* is in movement sideways and upwards until handle 8*a* stoppage 15*a* reaches the base support 2 stoppage 5*a* and click to lock handle 8*a* and stay in an open position and that causes handle 8*a* to stay at approximately 90 degrees from the hook, hanger 7 with the support of the base support 2 stoppage 5*c* that prevents handle 8*a* bar, axis 12*a* from getting out of the base support 2 axle 4*a*, and as the handle 8*a* is all the way upwards, an open manner handle 8*a* is formed (one side open manner bag holder 1), and as handle 8*a* is in an open manner and as a hand pulls handle 8*b* sideways and upwards causes handle 8*b* bar, axis 12*b*(and tabs 9*b* and 9*d* that are connecting bar, axis 12*b* of handle 8*b*) to rotate with respect to the base support 2 axle 4*b* as the base support 2 hook, hanger 7 slides out of the handle 8*b* gap 18*b* and as the movement of the handle 8*b* sideways and upwards causes handle 8*b* tabs 16*b* and 16*d* to detach from the hook, hanger 7 and as the handle 8*b* is in movement (by hand) sideways and upwards (and as the handle 8*b* gap 19*b* allows the bar, axis 12*b* and the base support 2 axle 4*b* stoppages 5*b*, 5*d* to hold bar, axis 12*b* and rotate upwards to achieve the open manner bag holder 1 as shown in FIG. 2 and downwards to achieve the closed manner bag holder 1 as shown in FIG. 3 with respect of the base support 2 axle 4*b*) And as handle 8*b* is in movement sideways and upwards until handle 8*b* stop page 15*b* reaches the base support 2 stoppage 5*b* and click to lock handle 8*b* and stay in an open position and that causes handle 8*b* to stay at approximately 90 degrees from the hook, hanger 7 with the support of the base support 2 stoppage 5*d* that prevents handle 8*b* bar, axis 12*b* from getting out of the base support 2 axle 4*b*, and the bag holder 1 as shown in FIG. 2 is formed, (and or, one hand may hold handle 8*a* and another hand may hold handle 8*b* and as both hands may pulling handles 8*a* and 8*b* from the base support 2 hook, hanger 7 sideways and all the way upwards until the handles 8*a* and 8*b* stoppages 15*a* for handle 8*a* and 15*b* for handle 8*b* are reaching the base support 2 stoppages 5*a* and 5*b* and are locked to form the open manner bag holder 1 as shown in FIG. 2). as handles 8*a* and 8*b* are lifted all the way upwards and form an open manner bag holder 1 as shown in FIG. 2, and as a hand 50 holds the open manner bag holder 1 as shown in FIG. 1, and another hand holds the bag 70 by the bag 70 handles 72 and as a hand slides bag 70 handles 72 through the entrance, exit path 111 and on the hook tab 6 and all the way into the hook, hanger 7 gap, space 3 until bag 70 handles 72 are inside the hook, hanger 7 gap, space 3 and inside the open manner bag holder 1 (as shown in FIG. 1) and the bag 70 and the bag holder 1 are connected and as a one unit, the open manner bag holder 1 (as shown in FIG. 1 with the bag 70 connected to the hook, hanger 7) is formed (as shown in FIG. 1) and as a hand 50 holds the bag holder (as shown in FIG. 1) by the handles 8*a* and 8*b* that are connected to the base support 2 via axles 4*a* and 4*b*, and as a hand 50 lifts the bag holder as shown in FIG. 1 with the bag 70 that is connected to the bag holder via bag handles 72 and as a hand 50 lifts the bag holder 1 upwards and from the ground (assuming that the bag 70 is laying on the ground and or may be connected to each other in the air and from the ground as one hand 50 holds the bag holder 1 and another hand holds the bag 70 handles 72 and inserts the bag 70 handles 72 in the air and held by hands) causes the bag 70 (assuming that the bag 70 contains any kind of load and approximately 1-50 lbs of weight) handles 72 to stretch and hang on the bag holder 1 hook, hanger 7 as the bag 70 pulls the bag holder downwards with the force of gravity and as the hand 50 lifts the bag holder with the bag 70 that is connected to the bag holder 1 via bag 70 handles 72, and as the bag 70 is leaving the ground as the hand 50 lifts the bag holder 1 upwards and from the ground causes pressure on the handles 8*a* and 8*b* bars 12*a* and 12*b* and causes pressure on the hook, hanger 7 and the base support 2 axles 4*a* and 4*b* as the handles 8*a* and 8*b* bars, axis's 12*a* and 12*b* that are connected to the base support 2 axles 4*a* and 4*b* and held by the stoppages 5*a*, Sc for the handle 8*a* and stoppages 5*b* and 5*d* for the handle 8*b*, and as a hand 50 holds the bag holder 1 by the handles 8*a* and 8*b* and with the bag 70 handles 72 inside the hook, hanger 7 and are lifted from the ground upwards the reaction is that the bag 70 is pulling the bag holder base support 2 downwards and to the ground by the force of gravity, and the handles 8*a* and 8*b* that are connected to the base support 2 and held by a hand 50 as the handles 8*a* and 8*b* stoppages 15*a* and 15*b* along with the base support 2 stoppages 5*a* and 5*b* are holding the pressure (pressure that the bag 70 and hand 50 is putting on the bag holder as the bag 70 is pulling down wards and the hand 50 is pulling upwards as a contrasts of the two that one is pulling upwards and the other is pulling downwards) and preventing handles 8*a* and 8*b* from moving further then 90 degrees each handle 8*a* and 8*b* as the base support 2 stoppages 5*a*, 5*c* and 5*b*, 5*d* are preventing from handles 8*a* and 8*b* bars, axis's 12*a* and 12*b* from snapping (detaching) out of the base support 2 axles 4*a* and 4*b* when the bag holder is loaded for carrying shopping bags 70. And As the hand 50 is holding the bag holder 1 as shown in FIG. 1 and as the bag 70 handles 72 hangs on the bag holder as the bag holder 1 is lifted from the ground, more bag 70 handles 72 may be inserted inside the hook, hanger 7 through the entrance, exit path 111 and into the gap, space 3 by a hand and the bag holder 1 may be put on the ground as the base support 2 hook tab 6 will keep bag 70 handles 72 from getting out of the hook, hanger 7 (and or handles 8*a* and 8*b* may be folded down and may form a closed manner bag holder as shown in FIG. 3 and with bag 70 handles 72 inside the hook, hanger 7 and inside the gap, space 3) and may allow for more bag 70 handles 72 to fit inside the hook, hanger 7, and the bag holder 1 may be lifted from the ground and put down on the ground again and again until reaching the desired destination and want to release bag 70 handles 72 from the bag holder 1.

Unloading the bag holder 1 from bag 70, as the hand 50 holds the bag holder 1 (as the bag holder neck 44 is between the hand 50 fingers as shown in FIG. 1) and another hand holds the bag 70 handles 72 and as a hand that is holding the bag 70 handles 72 slides the bag 70 handles 72 that are into the gap. Space 3 and leads the bag 70 handles 72 to the entrance, exit path 111 and slides the bag 70 handles 72 on the hook tab 6 and through the entrance, exit path 111 and all the way out of the hook, hanger 7 until one hand 50 holds the bag holder (now without the bag 70) and another hand holds the bag 70 handles 72 (now without the bag holder 1), and both the bag holder 1 (now without the bag 70) and the bag 70 are separated from each other.

Folding of the open manner bag holder 1, as the bag 70 handles 72 and the bag holder 1 are separated from each other and the bag holder is in an open manner bag holder 1, as the hand 50 (the folding of the bag holder may be achieved with one hand 50 and or with two hands 50 and assuming that the folding of the bag holder 1 is with two hands) holds the bag holder 1 (open manner) from the hook, hanger 7 and pulls handles 8*a* and 8*b* downwards by the fingers causes the handles 8*a* and 8*b* stoppages 15*a* and 15*b* to detach from the base support 2 stoppages 5*a* and 5*b* and causes the handles 8*a* and 8*b* bars, axis's 12*a* and 12 to rotate with respect to the base support 2 axles 4*a* and 4*b* and as the handles 8*a* and 8*b* are in movement downwards as the base support 2 stoppages 5*a* and 5*c* are moving further from the handles 8*a* and 8*b* stoppages as the base support 2 stoppages 5*b* and 5*d* are sliding into the handles 8*a* and 8*b* gaps 19*a* and 19*b* with respect of the base support 2 axles 4*a* and 4*b* and with respect of the handles 8*a* and 8*b* bars, axis's 12*a* and 12*b*, as the handles 8*a* and 8*b* tabs 9*a*,9*c* of handle 8*a* and 9*b*,9*d* of handle 8*b* that are holding the handles 8*a* and 8*b* bars, axis's 12*a* and 12*b* are also moving with the handles 8*a* and 8*b* bars, axis's 12*a* and 12*b* with respect to the base support 2 axles 4*a* and 4*b*, and as the hand 50 pushes handle 8*a* downwards and all the way until the base support 2 hook, hanger 7 slides into the handle 8*a* tabs 16*a*, 16*c* and on one side of the hook, hanger 7 as the hook, hanger 7 slides into the handle 8*a* gap 18*a* causes a lock of handle 8*a* with the base support 2 hook, hanger 7 on one side of the bag holder, and as the hand 50 pushes handle 8*b* downwards and all the way until the base support 2 hook, hanger 7 slides into the handle 8*b* tabs 16*b*, 16*d* and on one side of the hook, hanger 7 as the hook, hanger 7 slides into the handle 8*b* gap 18*b* causes a lock of handle 8*b* with the base support 2 hook, hanger 7 on the other side of the bag holder and as handles 8*a* and 8*b* are folded down and touching the base support 2 hook, hanger 7, the closed manner bag holder as shown in FIG. 3 is achieved.

A Method for Carrying Shopping Bags and Packages

A method for carrying shopping bags and packages that folds and transforms a small device that opens up and transforms to become a wide and long handle for carrying shopping bags and packages with a hook centered between two halve handles that once both halve handles 8*a* and 8*b* are opened and form a wide and long handle for the hand to hold and carry shopping bags and packages. Comprises, a base support 2, a connection hole 14, a neck 44, a hook, hanger 7, a hook tab 6, a gap, space 3, an entrance, exit path 1, a handle

8*a* and handle 8*b* connected to the base support 2 axles 4*a*(for the handle 8*a*) and 4*b*(for the handle 8*b*) via bar, axis 12*a*(of the handle 8*a*) and bar, axis 12*b* (of the handle 8*b*) as axles 4*a* and 4*b* connecting handles 8*a* and 8*b* bars, axis's 12*a* and 12*b* to the base support 2 as handle 8*a* tabs 9*a*,9*c* supporting handle 8*a* bar, axis 12*a*, and handle 8*b* tabs 9*b*,9*d* supporting handle 8*b* bar, axis 12*b*, as bars, axis's 12*a* and 12*b* allowing handles 8*a* and 8*b* to rotate with respect to the base support 2 axles 4*a* and 4*b* upwards from the base support 2 hook, hanger 7 (as shown in FIG. 2 as the open manner bag holder 1), and downwards and to the hook, hanger 7 (as shown in FIG. 3 as the closed manner bag holder 1), providing the folded manner bag holder 1 as shown in FIG. 3 and the open manner bag holder 1 as shown in FIG. 3, as a hand 50 lifts handles 8*a* and 8*b* sideways and upwards from the hook, hanger 7 rotating handles 8*a* and 8*b* upwards on axles 4*a* and 4*b* relative to the base support 2 axles 4*a* and 4*b* and removing handles 8*a* and 8*b* tabs 16*a*, 16*c* and the handle 8*b* tabs 16*b* and 16*d* from the base support 2 hook, hanger 7, causes handles 8*a* and 8*b* bars, axis's 12*a* and 12*b* to rotate upwards with respect to the base support 2 axles 4*a* and 4*b* and as a hand 50 lifts the handles 8*a* and 8*b* all the way upwards to the base support 2 stoppages 5*a* and 5*b* as the handles 8*a* and 8*b* stoppages 15*a* and 15*b* click with the base support 2 stoppages 5*a* and 5*b* causing the handles 8*a* and 8*b* to stop from moving further then 90 degrees each handle (8*a* and 8*b*) and form an approximately 180 degrees line together from the hook, hanger 7 (creating a T shaped open manner bag holder as shown on FIG. 2), as the open manner bag holder 1 as shown in FIG. 2 is achieved, providing a bag 70 as shown in FIG. 1, as a bag 70 (assuming that the bag 70 contains weight) handles 72 are held by a hand and as the bag holder 1 is held by another hand 50 (assuming that both hands are used for the loading of the bag 70 handles 72 on the bag holder and are called hand that holds the bag 70 handles 72 and a hand 50 that holds the open manner bag holder), as the bag 70 handles 72 are inserted on the hook, hanger 7 hook tab 6 through the entrance, exit hole 1 and into the hook, hanger 7 gap, space 3, causing the bag 70 handles 72 to stay inside the hook, hanger 7 and into the gap, space 3 and held by the hook, hanger 7 hook tab 6 inside the hook, hanger 7 gap, space 3 (once the bag 72 handles 72 are inside the hook, hanger 7 and into the gap, space 3 the hook tab 6 holds the bag 70 handles from getting out of the hook, hanger 7 gap, space 3 until released by hand from the hook, hanger 6 from the gap, space 3 and through the entrance, exit path 1 and out of the base support 2 hook, hanger 7), as the bag holder 1 (as shown in FIG. 1) is loaded with the bag 70 handles 72 that are inside and connected to the bag holder 1 and as a hand 50 holds the open manner bag holder 1 (now connected with the bag 70 handles 72 as shown in FIG. 1), as the bag holder 1 is lifted upwards and from the ground by a hand 50, causes the bag 70 handles 72 to pull the bag holder by the bag hook, hanger 7 downwards and to the ground (by the force of gravity) as a hand 50 that is holding the bag holder 1 (as shown in FIG. 1) is pulling to lift the bag holder by the bag holder handles 8*a* and 8*b* and the base support 2 with the bag 70 handles 72 upwards, causes the hook, hanger 7 to carry the weight of the load that the bag 70 contains and pulls the handle 1 downwards (and to the ground by the force of gravity), as the hand 50 that holds the handles 8*a* and 8*b* and the base support 2, causes the handles 8*a*, (connected to the base support 2 axle 4*a* via bar, axis 12*a*) and 8*b* (connected to the base support 2 axle 4*b* via bar, axis 12*b*) that are lifted from the bottom up and from the hook, hanger 7 and to the base support 2 stoppages 5*a* and 5*b* to put the pressure that the hand 50 is putting on the bag holder 1 by pulling the bag holder 1 upwards and the pressure that the bag 70 is putting on the base support 2 hook, hanger 7 by pulling the bag holder 1 downwards and to the ground (by the force of gravity), the bag holder handles 8*a* and 8*b* that are held and prevented from moving further upwards and stopped by the base support 2 stoppages 5*a* and 5*b* and the handles 8*a* and 8*b* stoppages 15*a* and 15*b* and by the handles 8*a* and 8*b* bars, axis's 12*a* and 12*b* that are connected to the base support 2 axles 4*a* and 4*b* stoppages 5*a*, 5*c*(for the handle 8*a* bar, axis 12*a* that is connected by tabs 9*a*, 9*c*)) and stoppages 5*b*, 5*d* (for the handle 8*b* bar, axis 12*b* that is connected by tabs 9*b*, 9*d*) that are holding handles 8*a* and 8*b* bars, axis's 12*a* and 12*b* into the base support 2 axles 4*a* and 4*b* and into the base support 2 gaps 32*a*(for the handle 8*a* bar, axis 12*a*) and 32*b* (for the handle 8*b* bar, axis 12*b*), as the handles 8*a* and 8*b* and the base support 2 are shearing the pressure that the bag 70 (that is connected to the base support 2 hook, hanger 7 by the bag 70 handles 72) that is pulling downwards and to the ground and the pressure that the hand 50 is putting on the bag holder that is pulling the bag holder upwards (by force) and from the ground, as a hand 50 holds the bag holder 1 with the bag 70 handles 72 in the bag holder 1 (as shown in FIG. 1) hook hanger 7 and in the gap, space 3 and as the bag holder 1 is lifted upwards and from the ground by a hand 50, the base support 2 stoppages 5*a* and 5*b* and the handles 8*a* and 8*b* stoppages 15*a* and 15*b* along with the base support 2 stoppages 5*c* and 5*d* are stopping and holding handles 8*a* and 8*b* bars, axis's 12*a* and 12*b* from moving further upwards (180 degrees line and as a T shaped handle) and from detaching (stoppages 5*c* and 5*d* are holding the pressure that handles 8*a* and 8*b* bars, axis's 12*a* and 12*b* are put on by the hand 50 and the bag 70 along with the handles 8*a* and 8*b* stoppages 15*a* and 15*b* that are held by the base support 2 stoppages 5*a* and 5*b*) from the base support 2 axles 4*a* and 4*b* as the bag holder 1 is pressured from both the bag 70 that is pulling downwards (by the force of gravity) by the bag 70 handles 72 that is connected to the bag holder hook, hanger 7 (and stretched on the base support 2 hook, hanger 7 as shown in FIG. 1), and the hand 50 that is pulling the bag holder 1 upwards and from the ground with the bag 70 handles 72 connected to the bag holder 1 that is pulling downwards and to the ground (assuming that the bag 70 contains some weight), as the open manner bag holder 1 is in use and lifted by a hand 50 (may allow for more bag 70 handles 72 to be inserted into the hook, hanger 7 once in the air and held by hand 50 off the ground) and may be put down on the ground, in the car, etc, etc, as the bag 70 handles 72 are staying inside the gap, space 3 and held by the hook tab 6 from getting out of the hook, hanger 7 as more bag 70 handles 72 may be inserted into the hook, hanger 7 through the hook tab 6 entrance, exit path 1 and into the gap, space 3 (as the bag holder is put on the ground with the bag 70 handles 72 inside the bag holder hook, hanger 7 and into the gap, space 3 the handles 8*a* and 8*b* and or handle 8*a* or handle 8*b* may be folded down and to the hook hanger 7 as shown in FIG. 3 as a closed manner bag holder 1 but now with the bag 70 handles 72 inside the hook, hanger 7 and the handles folded for a better hold of the bag 70 handles 72 with the bag holder 1) and as the bag 70 with the bag holder 1 reach the desired destination, as a hand holds the bag 70 handles 72 and another hand 50 holds the bag holder 1, as the hand 50 holds the bag holder 1 and a hand holds the bag 70 handles 72 and leads the bag 70 handles 72 from the hook, hanger 7 gap, space 3 and into the entrance, exit path 111 (now exit path) and all the way until bag 70 handles 72 is out of the base support 2 hook, hanger 7 and as one hand 50 holds the bag holder 1 and another hand holds the bag 70 handles 72 and as the bag holder 1 (without the bag 70 and the hand 50 as shown in FIG. 1 or as shown in FIG. 2) and the bag 70 handles 72 are separated from each other.

As the bag 70 and the bag holder (or as shown in FIG. 2) are separated from each other, and the open manner bag holder 1 as described in FIG. 2 is with handles 8*a* and 8*b* upwards (as 90 degrees each handle 8*a* and 8*b* and as a T shaped handle) as a hand 50 moves the handles 8*a* and 8*b* downwards as the base support 2 stoppages 5*a* and 8*b* are detaching the handles 8*a* and 8*b* stoppages 15*a* and 15*b* and rotating the handles 8*a* and 8*b* bars, axis's 12*a* and 12*b* on the base support 2 axles 4*a* and 4*b* downwards As the base support 2 stoppages 5*c* and 5*d* are getting into the handles 8*a* and 8*b* gaps 19*a* and 19*b* with the movement of the handles 8*a* and 8*b* downwards and as the handles 8*a* and 8*b* moved all the way down to the hook, hanger 7 causing the hook, hanger 7 to slide into the handles 8*a* and 8*b* gaps 18*a* and 18*b* (or vice versa) as the handles 8*a* and 8*b* tabs 16*a*,16*c* and 16*b*,16*d* are allowing the base support 2 hook, hanger 7 to fit inside the handles 8*a* and 8*b* gaps 18*a* and 18*b* that as the handles 8*a* and 8*b* are closed all the way downwards and touching the base support 2 hook, hanger 7 forming the closed manner bag holder 1 as shown in FIG. 3.

A Method of Use with the Number of Steps for the Use of the Opening and Folding Bag Holder Providing FIGS. 1-2-3 as Guiding Figures Step 1, As a bag holder is in a closed manner (as shown in FIG. 3), as a hand 50 (shown in FIG. 1) holds the bag holder 1 and another hand (assuming that the bag holder is activated with two hands as either hand may be a right or left hand) moves to lift the handles 8*a* and 8*b* sideways and upwards from the hook, hanger 7 with respect to the base support 2 axles 4*a*, 4*b* and rotating handles 8*a* and 8*b* bars, axis's 12*a* and 12*b* on the base support 2 axles 4*a* and 4*b* from the hook, hanger 7 as the hook, hanger 7 is sliding out of the handles 8*a* and 8*b* tabs 16*a*,16*c* and 16*b*,16*d* gaps 18*a* and 18*b* on both sides of the hook, hanger 7 and all the way upwards until handles 8*a* and 8*b* stoppages 15*a* and 15*b* reach the base support 2 stoppages 5*a* and 5*b* and clicks the handles 8*a* and 8*b* stoppages 15*a* and 15*b* with the base support 2 stoppages 5*a* and 5*b* that holds the handles 8*a* and 8*b* in an open position with the hook, hanger 7 in the center and the open manner bag holder 1 is achieved (as shown in FIG. 2).

Step 2, as a hand 50 holds the open manner bag holder 1 by the handles 8*a* and 8*b* (as shown in FIG. 1) and another hand 50 holds the bag 70 by the bag 70 handles 72 and as a hand inserts the bag 70 handles 72 into the hook, hanger 7 through the entrance, exit path 1 (now entrance path) and into hook tab 6 and all the way into the gap, space 3 and all the way in the hook hanger 7 until the bag 70 handles 72 are inside the hook, hanger 7 and hanged on the hook, hanger 7 (as shown in FIG. 1).

Step 3, as a hand 50 holds the open manner bag holder 1 (as shown in FIG. 1) by the base support 2 with the handle 8*a* opened on one side of the base support 2 and the handle 8*b* opened on the other side of the base support 2, and having the base support 2 hook, hanger 7 in the center (allowing a long handle for the hand 50 to hold), and with the bag 70 handles 72 connected to the hook, hanger 7 and is with the hook, hanger 7 in the center of the base support 2 (as shown in FIG. 1).

Step 4, as a hand 50 holds the handles 8*a*, 8*b* and the base support 2 (as shown in FIG. 1) with the bag 70 connected and hanged on the hook, hanger 7 by the bag 70 handles 72, as a hand 50 lifts the bag holder 1 upwards from the ground and as the bag 70 is off the ground as the bag 70 handles 72 will stay on the hook, hanger 7 as the handles 8*a* and 8*b* will stay at 180 degrees with the support of the handles 8*a* and 8*b* bars, axis's 12*a* and 12*b* and the handles 8*a* and 8*b* stoppages 15*a* and 15*b* and with the support of the base support 2 stoppages 5*a*, 5*c* and 5*b*, 5*d* that are preventing from the handles 8*a* and 8*b* from moving further upwards and stay at 180 degrees line (as a T shape) with the bag 70 hanged on the hook, hanger 7 by the bag handles 72 and with the weight (assuming that the bag 70 contains weight) of the bag 70 centered on the bag holder 1.

Step 5, as a hand 50 holds the bag holder 1 with the bags 70 connected and hanged on the hook, hanger 7 by the bag handles 72 (as shown in FIG. 1), and is off the ground and held by a hand 50, the bag 70 may be put down on the ground by a hand 50 (a bag holder may allow for more bag 70 handles 72 to be inserted into the hook, hanger 7 even when is off the ground or when is on the ground), and may allow for more bag 70 handles 72 to be inserted through the hook tab 6 entrance, exit path 1 to the hook, hanger 7 and into the gap, space 3, and as long as the bag handles 72 are in the gap, space 3 and are held by the hook tab 6, the bag holder 1 hook tab 6 will hold and keep the bag 70 handles 72 from getting out of the hook, hanger 7 entrance, exit path 1 and stay inside the hook, hanger 7.

Step 6, once a bag 70 handles 72 are connected to a hook, hanger 7 and to the bag holder 1 and the user of the bag holder 1 arrive to the desired destination, as a hand holds the bag 70 handles 72 and another hand 50 holds the bag holder 1, as the hand 50 holds the bag holder 1 and as the hand holds the bag 70 handles 72 and leads the bag 70 handles 72 from the hook, hanger 7 gap, space 3 and into the entrance, exit path 1 (now exit path from inside out) and all the way outwards until bag 70 handles 72 are out of the base support 2 hook, hanger 7 and as one hand 50 holds the bag holder 1 (or as shown in FIG. 2) and another hand holds the bag 70 handles 72 and as the bag holder 1 (without the bag 70 and the hand 50 as shown in FIG. 2) and the bag 70 handles 72 are separated from each other, having the bag 70 and the bag holder 1 detached from each other, and the bag holder 1 (now without a load as shown in FIG. 2) is in itself and without any load and held by a hand 50.

Step 7, as a bag 70 handles 72 are out of the bag holder 1 and now as an open manner bag holder 1 as shown in FIG. 2, as a hand 50 holds the open manner bag holder 1 and moves to fold the handles 8*a* and 8*b* downwards and all the way to the hook, hanger 7 until the hook, hanger 7 slides into the handles 8*a* and 8*b* gaps 18*a* and 18*b* as the handles 8*a* and 8*b* tabs 16*a*,16*c* and 16*b*,16*d* are touching the hook, hanger 7 on both sides and a closed manner bag holder 1 as shown in FIG. 3 is achieved.

An option, A closed manner bag holder 1 may be used as a key holder once handles 8*a* and 8*b* are folded, as a key ring, snap hook, etc, etc may inserted in the connection hole 14 by a hand 50, and or, a key ring, a snap hook, a wire etc, etc may also be inserted or connected to the hook, hanger 7 by a hand 50 once the bag holder is in a closed manner bag holder, and or, a key ring, a snap hook, a hook with a latch, etc, etc, may be inserted or connected by a hand 50 into the hook, hanger 7 when the bag holder is in an open manner bag holder 1 through the hook tab 6 and through entrance, exit path 111 and into the gap, space 3, and the handles 8*a* and 8*b* may be folded all the way downwards by a hand 50 until the hook, hanger 7 slides into the handles 8*a* and 8*b* gaps 18*a* and 18*b* and the key ring, snap, hook, etc, etc may be closed inside the hook, hanger 7 as a way out of the entrance, exit path 111 may be closed by the handles 8*a* or 8*b*(or 8*b* or 8*a*). A key ring may stay inside the hook, hanger 7 until the handles 8*a* and 8*b* are lifted upwards and the entrance, exit path 111 is open and clear for letting items get in and out of the hook, hanger 7 gap, space 3.

An option, a hook hanger 7 may be used as a cart or trolley locking mechanism opener as the hook, hanger 7 may be shaped as a coin size hook, hanger 7 and that may be inserted into the cart or trolley locking mechanism for releasing cart or trolley. And the bag holder may stay connected to the cart or trolley and or may slide out of the cart or trolley leaving the bag holder and the cart or trolley separated from one another.

What is claimed is:

1. A bag holder comprising a base support and a pair of handles; whereby the said base support comprises a connection hole, a pair of upper stoppages, a pair of axles that form two gaps, a pair of lower stoppages, a vertical neck that ends in a rounded hook that creates a space and ends, in turn, in a hook tab; whereby the gap between the hook tab and the main body of the base support constitutes an exit/entrance path; whereby each of said handles comprises a main body whose bottom part has at one end a connection gap that is formed by a pair of tabs whose upper part constitute a stoppage; whereby the connection gap includes an axis; whereby the main body of each handle has at its other end a stopping gap that is formed by a pair of tabs.

2. The bag holder as described in claim 1 whereby said base support also has a pair of slots in a side wall of said hook that are positioned so that when said bag holder is in closed position, the slots are located between said tabs; and whereby each of said handle also include one or more locking tabs.

* * * * *